US006057046A

United States Patent [19]

Tsuda et al.

[11] Patent Number: 6,057,046

[45] Date of Patent: May 2, 2000

[54] NITROGEN-CONTAINING SINTERED ALLOY CONTAINING A HARD PHASE

[75] Inventors: Keiichi Tsuda; Kazutaka Isobe; Akihiko Ikegaya; Nobuyuki Kitagawa, all of Hyogo, Japan

[73] Assignee: Sumitomo Electric Industries, Ltd., Osaka, Japan

[21] Appl. No.: 08/709,176

[22] Filed: Sep. 6, 1996

Related U.S. Application Data

[63] Continuation-in-part of application No. 08/444,044, May 18, 1995, abandoned.

[30] Foreign Application Priority Data

May 19, 1994 [JP] Japan ..... 6-105584
Feb. 15, 1995 [JP] Japan ..... 7-49290

[51] Int. Cl.[7] ..... B22F 3/00

[52] U.S. Cl. ..... 428/551; 428/557; 428/698; 428/699; 75/240

[58] Field of Search ..... 428/547, 548, 428/551, 552, 553, 554, 557, 558, 559, 564, 565, 698, 697; 75/236, 237, 238, 241, 242, 244, 240; 51/307; 501/87, 93

[56] References Cited

U.S. PATENT DOCUMENTS

| | | | |
|---|---|---|---|
| 3,936,295 | 2/1976 | Cromwell et al. | 75/0.5 R |
| 3,971,656 | 7/1976 | Rudy | 75/203 |
| 3,994,692 | 11/1976 | Rudy | 29/182.5 |
| 4,019,874 | 4/1977 | Moskowitz | 75/241 |
| 4,047,897 | 9/1977 | Tanaka et al. | 428/539.5 |
| 4,049,876 | 9/1977 | Yamamoto et al. | 428/932 |
| 4,120,719 | 10/1978 | Nomura et al. | 75/238 |

(List continued on next page.)

FOREIGN PATENT DOCUMENTS

| | | |
|---|---|---|
| 0246211 | 11/1987 | European Pat. Off. . |
| 0368336 | 5/1990 | European Pat. Off. . |
| 0499223 | 8/1992 | European Pat. Off. . |
| 0515340 | 11/1992 | European Pat. Off. . |
| 0603143 | 6/1994 | European Pat. Off. . |
| 0635580 | 1/1995 | European Pat. Off. . |
| 01287246 | 11/1989 | Japan . |
| 2-15139 | 1/1990 | Japan . |
| 02088742 | 3/1990 | Japan . |
| 5-9646 | 1/1993 | Japan . |
| 89-17373 | 12/1989 | Rep. of Korea . |
| 94-18473 | 8/1994 | Rep. of Korea . |
| 176194 | 1/1992 | Taiwan . |

OTHER PUBLICATIONS

Hisashi Suzuki et al. "The β–Free Layer Formed Near the Surface of Vacuum–Sintered WC–β–CO Alloys Containing Nitrogen", Transactions of the Japan Institute of Metals, vol. 22, No. 11, (1981) pp. 758–764.

(List continued on next page.)

*Primary Examiner*—Kathryn Gorgos
*Assistant Examiner*—Thomas H Parsons
*Attorney, Agent, or Firm*—W. F. Fasse; W. G. Fasse

[57] ABSTRACT

A nitrogen-containing sintered alloy includes at least 75 and not more than 95 percent by weight of a hard phase containing Ti, a group 6A metal and WC in a prescribed composition, and at least 5 and not more than 25 percent by weight of a binder phase containing Ni, Co and unavoidable impurities. The alloy contains at least 5 and not more than 60 percent by weight of a carbide, nitride or carbonitride of Ti, and at least 30 and not more than 70 percent by weight of a carbide of a metal belonging to the group 6A of the periodic table. The atomic ratio of nitrogen/(carbon+nitrogen) in the hard phase is at least 0.2 and less than 0.5. The alloy includes a soft layer containing a binder phase metal and WC at its outermost surface, and includes a layer that hardly contains any of the hard phase containing WC in a region immediately under the soft layer, with a thickness of at least 3 μm and not more than 30 μm. A nitrogen-containing sintered alloy with such a composition can be employed as a cutting tool having a high reliability even without a surface coating and even for working under conditions causing strong thermal shock.

24 Claims, 3 Drawing Sheets

U.S. PATENT DOCUMENTS

| | | | |
|---|---|---|---|
| 4,150,984 | 4/1979 | Tanaka et al. | 75/238 |
| 4,212,671 | 7/1980 | Ettmayer et al. | 75/238 |
| 4,265,662 | 5/1981 | Miyake et al. | 75/238 |
| 4,276,096 | 6/1981 | Kolaska et al. | 148/16.6 |
| 4,277,283 | 7/1981 | Tobioka et al. | 75/238 |
| 4,417,922 | 11/1983 | Hall et al. | 75/236 |
| 4,451,292 | 5/1984 | Hall et al. | 75/238 |
| 4,548,786 | 10/1985 | Yohe | 419/29 |
| 4,574,011 | 3/1986 | Bonjour et al. | 75/241 |
| 4,610,931 | 9/1986 | Nemeth et al. | 428/547 |
| 4,636,252 | 1/1987 | Yoshimura et al. | 75/238 |
| 4,769,070 | 9/1988 | Tobioka et al. | 75/238 |
| 4,778,521 | 10/1988 | Iyori et al. | 75/237 |
| 4,830,930 | 5/1989 | Taniguchi et al. | 428/547 |
| 4,911,625 | 3/1990 | Begg et al. | 419/6 |
| 4,911,989 | 3/1990 | Minoru et al. | 428/547 |
| 4,950,328 | 8/1990 | Odani et al. | 75/240 |
| 4,985,070 | 1/1991 | Kitamura et al. | 75/238 |
| 5,059,491 | 10/1991 | Odani et al. | 428/614 |
| 5,106,674 | 4/1992 | Okada et al. | 428/217 |
| 5,110,543 | 5/1992 | Odani et al. | 419/29 |
| 5,186,739 | 2/1993 | Isobe et al. | 75/238 |
| 5,248,352 | 9/1993 | Nakahara et al. | 148/421 |
| 5,296,016 | 3/1994 | Yoshimura et al. | 75/238 |
| 5,306,326 | 4/1994 | Oskarsson et al. | 75/238 |
| 5,314,657 | 5/1994 | Ostlund | 419/15 |
| 5,336,292 | 8/1994 | Weinl et al. | 75/230 |
| 5,376,466 | 12/1994 | Koyama et al. | 428/698 |
| 5,395,421 | 3/1995 | Weinl et al. | 75/238 |
| 5,421,851 | 6/1995 | Oskarsson et al. | 75/238 |
| 5,436,071 | 7/1995 | Odani et al. | 428/336 |

OTHER PUBLICATIONS

JIS B 4053—1989 (Japanese Industrial Standard) "Hard Tool Materials and Classification of Applicability"; UDC 621.9.025.7:699.081.25; (pp. 1–10), 1989. No Month Available.

JIS B 4120–1985 (Japanese Industrial Standard) Indexable Inserts for Cutting Tools–Designation); UDC 621.9.025.7; (pp. 1–8), 1985. No Month Available.

JIS G 4105—1979 (Japanese Industrial Standard) "Chromium Molybdenum Steels"; UDC 669.14–41:669.15'26'28–194; (pp. 1,2), 1979. No Month Available.

SEM PHOTOGRAPH

EDX ANALYSIS (Co)

EDX ANALYSIS (Ni)

NITROGEN-CONTAINING SINTERED ALLOY CONTAINING A HARD PHASE

CROSS-REFERENCE TO RELATED APPLICATION

The present application is a Continuation-In-Part application of our commonly assigned application U.S. Ser. No. 08/444,044, filed on May 18, 1995, (now abandoned) the disclosure of which is incorporated herein by reference.

BACKGROUND OF THE INVENTION

1. Field of the Invention

The present invention relates to a nitrogen-containing sintered alloy comprising a hard phase, and more particularly, it relates to a nitrogen-containing sintered alloy which is improved in thermal shock resistance, wear resistance and strength for serving as a material for a cutting tool and enabling application to wet cutting.

2. Description of the Background Art

A nitrogen-containing sintered alloy having a hard phase of a carbo-nitride mainly composed of Ti, which is bonded by a metal binder phase containing Ni and Co, has already been put into practice as a cutting tool. This nitrogen-containing sintered alloy is widely used for a cutting tool in a manner similar to the so-called cemented carbide, which is mainly composed of WC, since the hard phase is much finer than that of a conventional sintered alloy that is free of nitrogen, whereby the high-temperature creep resistance is remarkably improved.

In this nitrogen-containing sintered alloy comprising a hard phase, however, the resistance against thermal shock is reduced for the following reasons. First, the thermal conductivity of this nitrogen-containing sintered alloy comprising a hard phase is about half that of the cemented carbide, since the thermal conductivity of Ti, which is the main component of the carbonitride, is extremely smaller than that of WC, which is the main component of the cemented carbide. Secondly, the thermal expansion coefficient of the nitrogen-containing sintered alloy comprising a hard phase is about 1.3 times that of the cemented carbide, since this coefficient also depends on the characteristic value of the main component in a manner similar to the thermal conductivity.

Therefore, the nitrogen-containing sintered alloy has a disadvantageously inferior reliability as compared to a coated cemented carbide or the like in cutting operations that cause a particularly strong thermal shock such as milling, cutting of a square timber with a lathe, or wet copying with remarkable variation in depth of cut, for example.

In order to solve such problems of the conventional nitrogen-containing sintered alloy comprising a hard phase, various improvements have been attempted as follows. For example, Japanese Patent Laying-Open No. 2-15139 (1990) proposes means of improving surface roughness of a material containing at least 50 percent by weight of Ti in terms of a carbide or the like and less than 40 percent by weight of an element belonging to the group 6A (the group VIB in the CAS version) of the periodic table in terms of a carbide and having an atomic ratio N/(C+N) of 0.4 to 0.6 with a high nitrogen content by controlling the sintering atmosphere, for forming a modified part having high toughness and hardness in a surface layer thereof. On the other hand, Japanese Patent Laying-Open No. 5-9646 (1993) discloses a cermet prepared by sintering a material mainly composed of Ti and containing less than 40 percent by weight of W, Mo and Cr in total in terms of a carbide, and thereafter controlling a cooling step for providing a surface layer of the cermet with a region having a smaller amount of binder phase as compared with the interior, to leave compressive stress on the surface.

However, each of the cermets disclosed in the aforementioned Japanese Patent Publications is insufficient in chipping resistance as compared with the coated cemented carbide, although wear resistance and toughness are improved. Further, the cermet is so inferior in thermal shock resistance that sudden chipping is easily caused by thermal cracking or crack extension resulting from both thermal and mechanical shocks in particular, and sufficient reliability cannot be attained. Although the manufacturing cost for such prior art materials is reduced due to the omission of a coating step, the performance cannot be sufficiently improved. Thus, the prior art suggests that the potential improvement in strength against chipping is naturally limited in the category of the so-called cermet, which is prepared on the premise that it contains Ti in excess of a certain amount.

The inventors have studied and analyzed cutting phenomena such as temperature distributions in various cutting operations and arrangements of material components in tools, and have thereby recognized the following.

During cutting, a cutting member is partially exposed to a high-temperature environment, for example at a surface of an insert that is in contact with a workpiece, a part of a rake face that is fretted by chips, and the like. The thermal conductivity of the cermet is about half that of the cemented carbide as hereinabove described. Hence, heat that is generated on the surface of the cermet is so little diffused into the interior that the temperature is abruptly reduced in the interior although the surface is at a high temperature. Once cracking is caused in such a state, the cermet is extremely easily chipped. Furthermore, when the cermet is rapidly quenched with water-soluble cutting oil from a high temperature state or cooled with cutting in lost motion, only an extremely small part of its surface is quenched.

Furthermore, the thermal expansion coefficient of the cermet is about 1.3 times that of the cemented carbide as hereinabove described. Hence, tensile stress is caused on a surface layer, which extremely easily causes thermal cracking. In relation to either characteristic, the cermet is inferior in thermal shock resistance to the cemented carbide.

Comparing the cermet and the cemented carbide having the same grain sizes and the same amounts of binder phases, the fracture toughness of the former is reduced by about 30 to 50% as compared with the latter. Hence, crack extension resistance is also reduced in the interior of the alloy.

In the conventional nitrogen-containing sintered alloy with a hard phase, as hereinabove described, there are limits to the improvement of thermal conductivity, reduction of the thermal expansion coefficient and improvement of crack extension resistance that can be achieved with a large content of Ti, and that can achieve an excellent machined surface in a manner that is advantageous in view of the resource.

SUMMARY OF THE INVENTION

An object of the present invention is to provide a nitrogen-containing sintered alloy comprising a hard phase that can be used for a cutting tool with high reliability without a surface coating, even for working under conditions causing a strong thermal shock, so as to avoid the need for the high-priced coated cemented carbide which has previously been employed in general.

According to a first aspect of the invention, a nitrogen-containing sintered alloy comprises a soft layer at an outermost surface of the alloy, a WC-depleted region immediately beneath the soft layer, and an internal core region beneath the WC-depleted region, wherein:

the sintered alloy has an overall phase content comprising at least 75 wt. % and not more than 95 wt. % of a hard phase and at least 5 wt. % and not more than 25 wt. % of a binder phase, the hard phase comprises WC and $(Ti \cdot W_xM_y)(C_uN_{1-u})$, where M represents at least one metal other than W selected from group 6A of the periodic table, $0<x<1$, $0 \leqq y \leqq 0.9$, and $0 \leqq u<0.9$, with an atomic ratio of N/(C+N) being at least 0.2 and less than 0.5, with at least one of TiC, TiN, and TiCN making up at least 5 wt. % and not more than 60 wt. % of an overall composition of the sintered alloy, and with a carbide of at least one metal selected from group 6A of the periodic table making up at least 30 wt. % and not more than 70 wt. % of the overall composition, the binder phase comprises Ni and Co, the soft layer contains WC and the binder phase, the WC-depleted region contains the binder phase and $(Ti \cdot W_xM_y)(C_uN_{1-u})$ and from 0 to 2 vol. % of WC, and has a thickness of at least 3 $\mu$m and not more than 30 $\mu$m, and the internal core region contains the binder phase and $(Ti \cdot W_xM_y)(C_uN_{1-u})$ and more than 2 vol. % of WC.

According to a second aspect of the invention, a nitrogen-containing sintered alloy comprises a soft layer at an outermost surface of the alloy, a WC-depleted region immediately beneath the soft layer, and an internal core region beneath the WC-depleted region, wherein:

the sintered alloy has an overall phase content comprising at least 75 wt. % and not more than 95 wt. % of a hard phase and at least 5 wt. % and not more than 25 wt. % of a binder phase, the hard phase comprises WC and $(Ti \cdot W_xM_y)(C_uN_{1-u})$, where M represents at least one metal other than Ti and W selected from at least one of groups 4A, 5A and 6A of the periodic table, $0<x<1$, $0 \leqq y \leqq 0.9$, and $0 \leqq u<0.9$, with an atomic ratio of N/(C+N) being at least 0.2 and less than 0.5, and with constituents of the $(Ti \cdot W_xM_y)(C_uN_{1-u})$ such that the sintered alloy has an overall composition comprising at least 5 wt. % and not more than 60 wt. % of at least one of TiC, TiN, and TICN, at least 30 wt. % and not more than 70 wt. % of a carbide of at least one metal selected from group 6A of the periodic table, at least 2 wt. % and not more than 15 wt. % total of at least one of TaC, TaN, TaCN, NbC, NbN, and NbCN, and at least 2 wt. % and not more than 5 wt. % total of at least one of VC, VN, VCN, ZrC, ZrN, ZrCN, HfC, HfN, and HfCN, the binder phase comprises Ni and Co, the soft layer contains WC and the binder phase, the WC-depleted region contains the binder phase and $(Ti \cdot W_xM_y)(C_uN_{1-u})$ and from 0 to 2 vol. % of WC, and has a thickness of at least 3 $\mu$m and not more than 30 $\mu$m, and the internal core region contains the binder phase and $(Ti \cdot W_xM_y)(C_uN_{1-u})$ and more than 2 vol. % of WC.

According to a third aspect of the invention, a nitrogen-containing sintered alloy comprises an exudation layer at an outermost surface of the alloy, and an internal core region beneath the exudation layer, wherein:

the alloy contains a hard phase and a binder phase, the hard phase comprises WC and at least one carbide, nitride or carbonitride of at least one transition metal selected from at least one of the groups 4A, 5A and 6A of the periodic table, the binder phase comprises Ni and Co, the internal core region contains the WC and the above mentioned at least one carbide, nitride or carbonitride, and the binder phase, the exudation layer contains the WC and the binder phase, and comprises an outermost layer at the outermost surface, an intermediate layer beneath the outermost layer, and an innermost layer beneath the intermediate layer, the outermost layer and the innermost layer each contain from 0 to 30 vol. % of the WC and a remainder of the binder phase, and each have a thickness of at least 0.1 $\mu$m and not more than 10 $\mu$m, and the intermediate layer contains from 50 to 100 vol. % of the WC with any remainder comprising the binder phase, and has a thickness of at least 0.5 $\mu$m and not more than 10 $\mu$m.

The foregoing and other objects, features, aspects and advantages of the present invention will become more apparent from the following detailed description of the present invention when taken in conjunction with the accompanying drawings.

Figure 1:
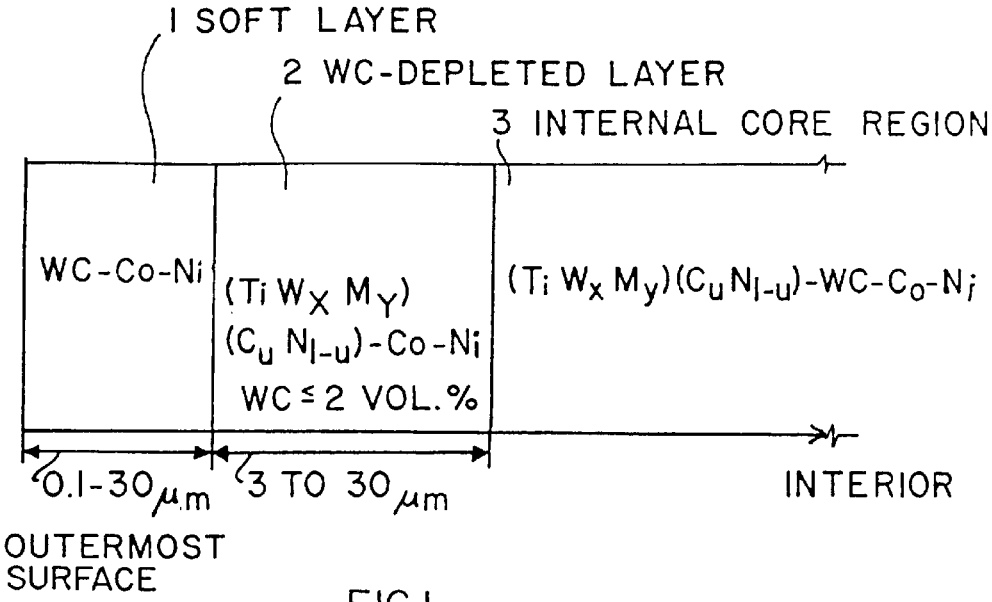
FIG. 1 is a schematic diagram of an alloy structure according to a first or a second aspect of the invention.

DETAILED DESCRIPTION OF THE PREFERRED EMBODIMENTS AND OF THE BEST MODE OF THE INVENTION

First and second aspects of the present invention will now be described in detail. The nitrogen-containing sintered alloy comprising a hard phase according to the present invention is provided in its interior with a larger amount of WC as compared with the structure of the conventional nitrogen-containing sintered alloy, whereby the present alloy is improved in resistance against crack extension. When a large amount of WC is blended, WC particles appear toward the alloy surface of the conventional nitrogen-containing sintered alloy to provide a tool material called a P-series hard tool material, which achieves an inferior smoothness of the machined surface. Therefore, this material is also remarkably inferior in abrasive wear resistance as compared to the so-called cermet or coated cemented carbide.

However, it has been proved that it is possible to eliminate WC particles from a soft layer that is present at the outermost surface of the tool, i.e., a surface layer up to a specific depth immediately under the so-called exudation layer. Such a soft surface layer determines the achieved smoothness of the machined surface. Thus, abrasive wear resistance and crater wear resistance can be remarkably improved, while the amount of a binder phase is reduced in the vicinity of the surface layer and a group 6A metal such as W is solidly solved in hard phase particles at the same time when cooling is carried out in a decarburizing atmosphere such as a vacuum. Further, the alloy surface is hardened and toughness can be improved by the effect that compressive stress against the surface part is caused by the difference in thermal expansion coefficient due to a gradient in the amount of the binder phase, whereby wear resistance and thermal shock resistance can be remarkably improved.

According to the first aspect of the present invention, the nitrogen-containing sintered alloy comprising a hard phase has an overall phase content including at least 75 percent by weight and not more than 95 percent by weight of a hard phase containing a solid solution of $(Ti \cdot W_xM_y)(C_uN_{1-u})$ (M represents at least one metal excluding W belonging to the group 6A of the periodic table, $0<x<1$, $0 \leqq y \leqq 0.9$, and $0 \leqq u<0.9$) and WC, and at least 5 percent by weight and not more than 25 percent by weight of a binder phase containing Ni, Co and unavoidable impurities. More specifically, the alloy contains at least 5 percent by weight and not more than 60 percent by weight of a carbide, a nitride or a carbo-nitride of Ti, and at least 30 percent by weight and not more than 70 percent by weight of a carbide of a metal belonging to the group 6A of the periodic table. The atomic ratio of nitrogen/(carbon+nitrogen) in the hard phase is at least 0.2 and less than 0.5.

As shown in FIG. 1, the nitrogen-containing sintered alloy has a soft layer 1, a WC-depleted layer 2, and an internal core region 3. The soft layer 1 contains or consists of a binder phase metal and WC, and is located at the outermost surface of the alloy. The WC-depleted layer 2 contains a hard phase including substantially no WC, is located immediately under the soft layer 1, and has a thickness of at least 3 $\mu$m and not more than 30 $\mu$m. Beneath the layer 2 is the internal core region 3 of the alloy, which contains a substantial amount of WC, preferably from 5 to 50 percent by volume, in addition to $(Ti \cdot W_xM_y)(C_uN_{1-u})$, in the hard phase.

The term "hard phase including substantially no WC" and the like used herein refers to a hard phase component formed of $(Ti \cdot W_xM_y)(C_uN_{1-u})$ with at most a very small amount of WC. In more concrete terms, the amount of WC in the WC-depleted layer 2 is preferably not more than 2 percent by volume and especially not more than 1 percent by volume. Thus, the "WC-depleted layer" could also be called a "low-WC-content layer". It should also be understood herein that the term "hard phase containing WC" refers to a hard phase component that substantially consists of WC and also may contain slight amounts of Ti and group 6A metals in solid solution with the WC, but is sometimes referred to simply as WC ignoring the slight amounts of Ti and group 6A metals.

In this nitrogen-containing sintered alloy comprising a hard phase according to the invention, the content of the hard phase is set in the range of at least 75 percent by weight and not more than 95 percent by weight, because wear resistance and plastic deformation resistance are remarkably reduced if the content of the hard phase is less than 75 percent by weight, while strength and toughness are insufficient if the content exceeds 95 percent by weight. The Ti content is set in the range of at least 5 percent by weight and not more than 60 percent by weight in terms of a carbide or the like, because wear resistance cannot reach a desired level if the Ti content is less than 5 percent by weight while toughness is deteriorated if the Ti content exceeds 60 percent by weight. The Ti content is preferably at least 5 percent by weight and not more than 50 percent by weight, and particularly preferably at least 20 percent by weight and not more than 50 percent by weight.

The content of the metal belonging to the group 6A of the periodic table is set in the range of at least 30 percent by weight and not more than 70 percent by weight in terms of a carbide, because the desired toughness cannot be attained if the content is less than 30 percent by weight while a large amount of WC particles remain in the surface and disadvantageously result in insufficient wear resistance if the content exceeds 70 percent by weight. The content of the metal belonging to the group 6A of the periodic table is preferably at least 40 percent by weight and not more than 70 percent by weight, more preferably at least 40 percent by weight and not more than 60 percent by weight in terms of the carbide.

The atomic ratio of nitrogen/(carbon+nitrogen) in the hard phase is set in the range of at least 0.2 and less than 0.5, because both toughness and wear resistance cannot reach desired levels if the atomic ratio is less than 0.2 while the degree of sintering is reduced and toughness is deteriorated if the atomic ratio exceeds 0.5. This atomic ratio is preferably at least 0.2 and less than 0.4.

Further, the thickness of the WC-depleted layer 2 that contains a hard phase including substantially no WC, is set in the range of at least 3 $\mu$m and not more than 30 $\mu$m immediately under the soft layer 1, because desired abrasive wear resistance and crater wear resistance cannot be attained if the thickness is less than 3 $\mu$m while an improvement in the crack extension resistance is not attained and toughness is reduced if the thickness exceeds 30 $\mu$m.

Figure 2:
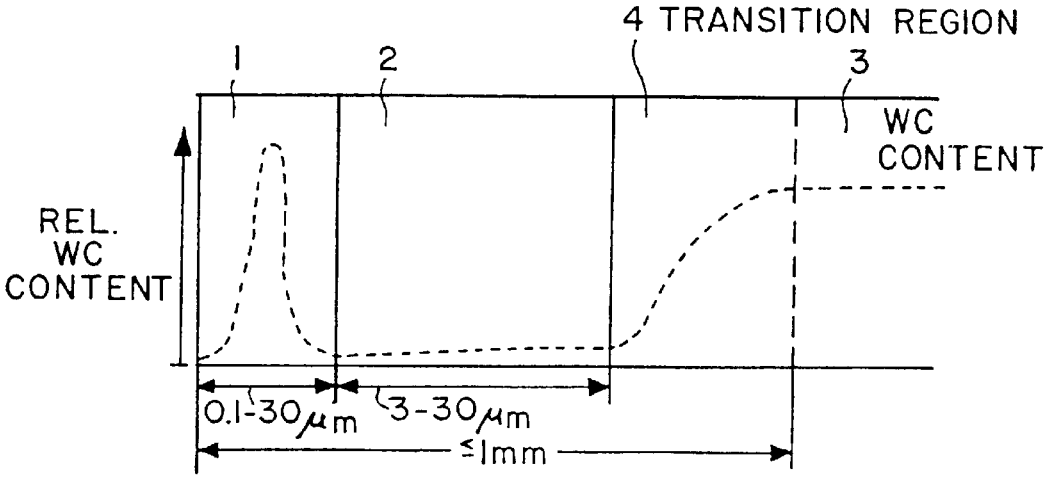
FIG. 2 is a schematic diagram of a further preferred feature of an alloy structure of a first or a second aspect of the invention.

In a preferred embodiment of the nitrogen-containing sintered alloy comprising a hard phase according to the present invention, as shown in FIG. 2, it is preferable that the abundance or proportional content of the hard phase containing WC is gradually increased through a transition region 4 toward the interior from the WC-depleted layer 2 including the hard phase that contains substantially no WC, up to a maximum depth of 1 mm from the outermost surface in the aforementioned composition, where the WC content reaches or approaches its overall average content in the internal core region 3. It should be understood that the WC-content curve shown in FIG. 2 is merely schematic and exemplary.

According to this structure, the abundance or proportional content of the hard phase containing WC is gradually increased toward the interior from the WC-depleted layer 2, which includes the hard phase containing substantially no WC (i.e. not more than 2 percent by volume or preferably not more than 1 percent by volume of WC), up to the maximum depth of 1 mm from the outermost surface, whereby an abrupt change of the WC content distribution is prevented in the boundary or transition region 4 between the regions 3 and 2, which respectively have and do not have substantial amounts of WC, so that the occurrence of residual stress is relieved in this boundary 4.

In the inventive nitrogen-containing sintered alloy comprising a hard phase, the abundance or proportional content of the hard phase containing WC is preferably at least 5 percent by volume and less than 50 percent by volume in the internal core region 3 of the alloy at a depth of at least 1 mm from the outermost surface in the aforementioned composition. This is because a desired effect of improving the toughness cannot be attained if the WC-containing hard phase content is less than 5 percent by volume while the toughness of the surface layer against thermal shock and the plastic deformation resistance of the alloy are reduced if the WC-containing hard phase content exceeds 50 percent by volume.

According to the second aspect of the present invention, on the other hand, the nitrogen-containing sintered alloy comprising a hard phase has an overall phase content including at least 75 percent by weight and not more than 95 percent by weight of a hard phase containing a solid solution of $(Ti \cdot W_x M_y)(C_u N_{1-u})$ (M represents at least one metal excluding Ti and W belonging to the groups 4A, 5A and 6A of the periodic table, corresponding to the groups IVB, VB and VIB in the CAS version respectively, $0<x<1$, $0 \leqq y \leqq 0.9$, and $0 \leqq u<0.9$) and WC, and at least 5 percent by weight and not more than 25 percent by weight of a binder phase containing Ni, Co and unavoidable impurities. More specifically, the alloy contains at least 5 percent by weight and not more than 60 percent by weight of a carbide, a nitride or a carbo-nitride of Ti, and at least 30 percent by weight and not more than 70 percent by weight of a carbide of a metal belonging to the group 6A of the periodic table, at least 2 percent by weight and not more than 15 percent by weight of a carbide, a nitride or a carbo-nitride of Ta and Nb in total, and not more than 5 percent by weight of a carbide, a nitride or a carbonitride of V, Zr and Hf in total. The atomic ratio of nitrogen/(carbon+nitrogen) in the hard phase is at least 0.2 and less than 0.5.

The structure of this second aspect of the invention can also be understood with reference to FIGS. 1 and 2 with simply a different definition of the metal M in the hard phase. The nitrogen-containing sintered alloy has a soft layer 1, a WC-depleted layer 2, and an internal core region 3. The soft layer 1 contains or consists of a binder phase metal and WC, and is located at the outermost surface of the alloy. The WC-depleted layer 2 contains a hard phase including substantially no WC, is located immediately under the soft layer 1, and has a thickness of at least 3 μm and not more than 30 μm. The WC-depleted layer 2 is similar to that described above in the first aspect of the invention.

A functional effect similar to that of the composition according to the first aspect of the invention can be attained also when the nitrogen-containing sintered alloy contains a metal belonging to the group 4A of the periodic table excluding Ti and/or the group 5A in addition to the metal belonging to the group 6A of the periodic table excluding W, at least 2 percent by weight and not more than 15 percent by weight of a carbide, a nitride or a carbo-nitride of Ta and Nb in total, and not more than 5 percent by weight of a carbide, a nitride or a carbo-nitride of V, Zr and Hf in total. Crater wear resistance is not improved if the total content of Ta and Nb is less than 2 percent by weight in terms of a carbide or the like, while chipping resistance is reduced if the content exceeds 15 percent by weight. The alloy preferably contains V, Zr and Hf so as to be improved in strength and hardness under a high temperature, while the degree of sintering is reduced and chipping resistance is also reduced if the total content of V, Zr and Hf exceeds 5 percent by weight in terms of the carbide etc.

In the inventive nitrogen-containing sintered alloy of the second aspect, it is preferable that the proportional content of the hard phase containing WC is gradually increased through a transition region 4 toward the interior from the WC-depleted layer 2, which includes the hard phase containing substantially no WC, up to a maximum depth of 1 mm from the outermost surface in the aforementioned composition.

In the inventive nitrogen-containing sintered alloy, the proportional content of the hard phase containing WC is preferably at least 5 percent by volume and less than 50 percent by volume in the interior or internal core region 3 of the alloy at a depth of at least 1 mm from the outermost surface in the aforementioned composition.

A third aspect of the present invention will now be described. Thermal cracking is caused by a temperature difference between the surface and the interior of the alloy. In order to prevent such thermal cracking, the thermal conductivity of the nitrogen-containing sintered alloy itself may be improved, but the improvement of the thermal conductivity of the nitrogen-containing sintered alloy is naturally limited. As a result of study, however, it has been clarified that heat which is generated during cutting is conducted to the overall alloy to attain a heat divergence or fin effect when a layer that has a high thermal conductivity and that is rich in WC with a remainder being a metal binder phase mainly composed of Co and Ni is arranged at a surface of a nitrogen-containing sintered alloy comprising a hard phase.

Accordingly, a nitrogen-containing sintered alloy comprising a hard phase according to the third aspect of the present invention, based on the aforementioned results of the study, includes a hard phase containing WC as an essential element and a carbide, a nitride or a carbo-nitride of at least one transition metal selected from the groups 4A, 5A and 6A of the periodic table or a composite carbo-nitride thereof, and a binder phase containing Ni, Co and unavoidable impurities, and has the following structure and composition, as shown, for example, in FIGS. 3 to 6.

An exudation layer 1' containing a metal binder phase, mainly composed of Ni and Co, and WC is present on an alloy surface part (see FIGS. 3 to 6). This exudation layer 1' is a specific type or definition of the above discussed soft layer 1, and is internally divided into three layers including an outermost layer 1A containing from 0 to 30 percent by volume (preferably 0 to 5 percent by volume) of WC with a remainder formed by a metal binder phase that is mainly composed of Co and Ni, an intermediate layer 1B containing at least 50 percent by volume and not more than 100 per cent by volume (preferably 80 to 100 percent by volume) of WC with a remainder formed by a metal binder phase that is mainly composed of Co and Ni, and a lowermost or innermost layer 1C containing from 0 to 30 percent by volume (preferably 0 to 5 percent by volume) of WC with a remainder formed by a metal binder phase that is mainly composed of Co and Ni.

The outermost layer 1A and innermost layer 1C of the exudation layer 1' are at least 0.1 μm and not more than 10 μm (preferably 0.1 to 0.5 μm) in thickness, while the intermediate layer 1B is at least 0.5 μm and not more than 10 μm (preferably 0.5 to 5 μm) in thickness.

In the inventive nitrogen-containing sintered alloy having the aforementioned structure, thermal shock resistance is remarkably improved. While the outermost and innermost layers 1A and 1C are substantially rich in the metal binder phase mainly composed of Ni and Co, these layers are inevitably formed in the manufacturing steps, and no problem is caused in performance when the thicknesses thereof are in the aforementioned range.

Regarding the numeric limitations of the aforementioned structure, the intermediate layer 1B contains at least 50 percent by volume and not more than 100 per cent by volume of WC since the desired thermal conductivity cannot be attained and the layer cannot serve as a thermal divergence layer if the WC content is not at least and preferably more than 50 percent by volume with a remainder of the metal binder phase mainly composed of Co and Ni. The thickness of this intermediate layer 1B is set in the range of at least 0.5 μm and not more than 10 μm since the desired thermal conductivity cannot be attained if the thickness is less than 0.5 μm while the wear resistance is remarkably deteriorated if the thickness exceeds 10 μm.

Each of the outermost and innermost layers 1A and 1C, which are necessarily formed for obtaining the most important intermediate layer, must have a thickness of 0.1 μm, but these layers may cause welding with a main component of a workpiece and iron during cutting, leading to chipping, if the thickness exceeds 10 μm. It has been proved by a result of study that the cutting performance is not influenced if the outermost and innermost layers 1A and 1C are not more than 10 μm in thickness.

In a preferred embodiment, the inventive nitrogen-containing sintered alloy of the aforementioned structure has a binder phase-depleted region 5 containing absolutely no or not more than 2 percent by volume of a metal binder phase immediately under the exudation layer 1'. This region 5 has a thickness of at least 2 μm and not more than 100 μm (preferably 2 to 50 μm) measured from immediately under the exudation layer 1' toward the interior. According to this structure, the region 5 immediately under the exudation layer 1' has extremely high hardness, whereby both wear resistance and thermal shock resistance can be compatibly attained.

In the aforementioned structure, the binder-depleted surface region 5 of the alloy contains not more than 2 percent by volume of the metal binder phase that is mainly composed of Co and Ni, since a remarkable improvement of wear resistance is not achieved if the metal binder phase is present in a higher ratio. The thickness of the region 5 located immediately under the exudation layer 1' is set in the range of at least 2 μm and not more than 100 μm since an improvement of wear resistance is not recognized if the thickness of the region 5 is less than 2 μm, while the region 5 is rendered too hard and fragile, which deteriorates chipping resistance, if the thickness exceeds 100 μm.

In a more preferred embodiment of the inventive nitrogen-containing sintered alloy having the aforementioned structure, a WC-depleted region 6 containing absolutely no or not more than 2 percent by volume of WC is located immediately under the exudation layer 1' and has a thickness of at least 1 μm and not more than 500 μm (preferably 20 to 100 μm) toward the interior of the alloy. Under such conditions, further, the proportional content of WC is preferably gradually increased through a transition region 7 from the aforementioned region 6 located immediately under the exudation layer 1' toward the interior so that the volume percentage of WC reaches the average WC volume percentage of the overall alloy at a depth within 1 mm (preferably 0.3 to 0.7 mm) as measured from immediately under the exudation layer 1'. According to this structure, the Young's modulus of the overall alloy is increased due to the presence of WC, whereby mechanical strength is remarkably improved. Further, both thermal shock resistance and chipping resistance can be compatibly attained by providing WC only in the interior with no presence on the surface part of the alloy.

In the aforementioned structure, the thickness of the WC-depleted region 6 located immediately under the exudation layer 1', containing absolutely no or not more than 2 percent by volume of WC is set in the range of at least 1 μm and not more than 500 μm, since the wear resistance is deteriorated due to a reduction in hardness caused by WC if the thickness is less than 1 μm while the effect of improving the toughness of the alloy itself by WC cannot be attained if the thickness exceeds 500 μm.

Figure 3:
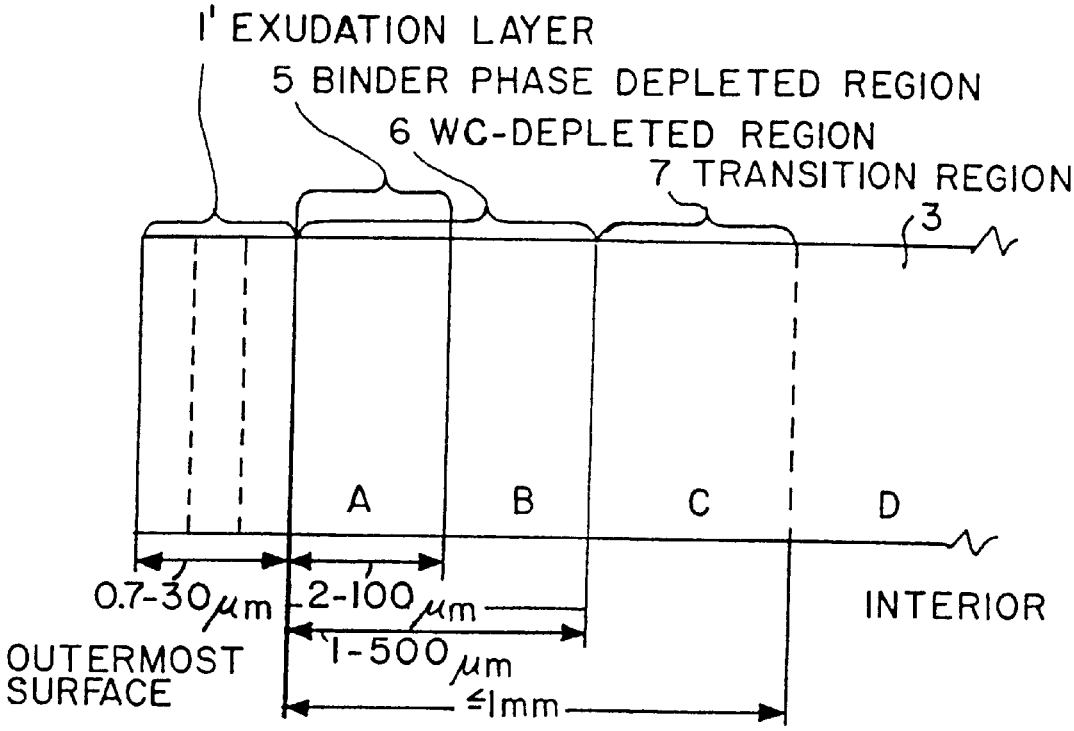
FIG. 3 is a schematic diagram of an alloy structure including preferred features according to a third aspect of the invention.
Figure 3A:
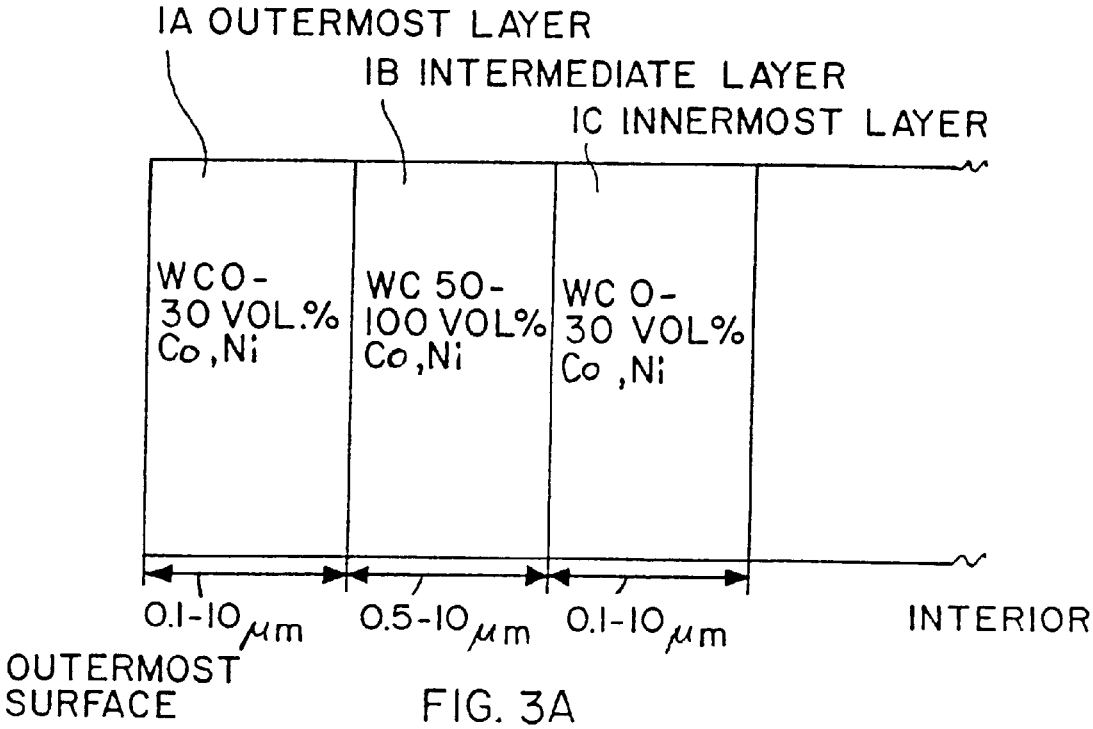
FIG. 3A is an enlarged detail schematic diagram of an exudation layer shown in FIG. 3.
Figure 4:
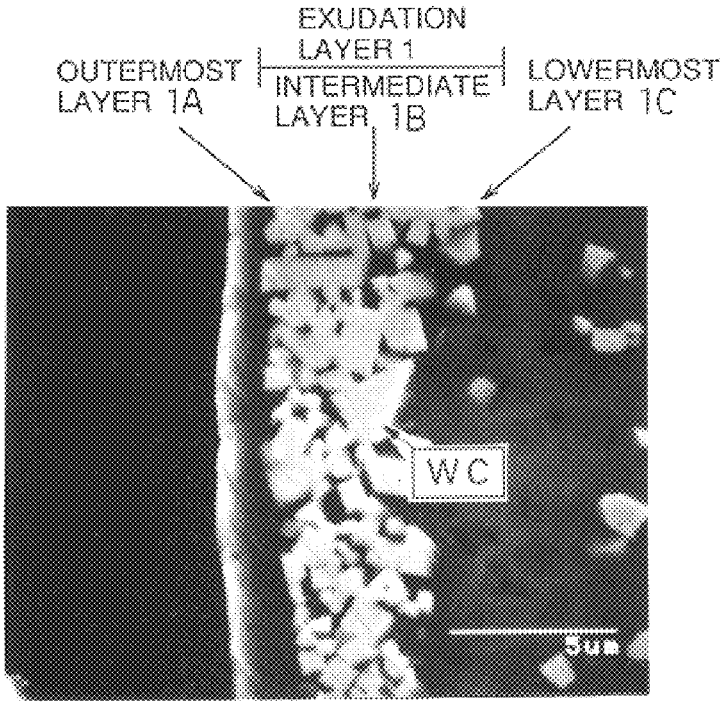
FIG. 4 is a microphotograph (SEM photograph) of an alloy structure indicating an exudation layer which is divided into three layers with Co and Ni binder layers as outermost and innermost layers and a WC layer as an intermediate layer.
Figure 5:
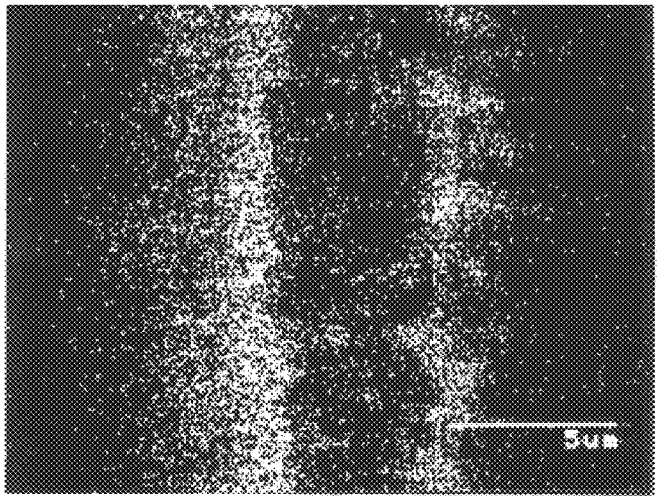
FIGS. 5 and 6 are microphotographs (EDX analysis) indicating distributions of Co and Ni elements, respectively, in the structure of FIG. 4.
Figure 6:
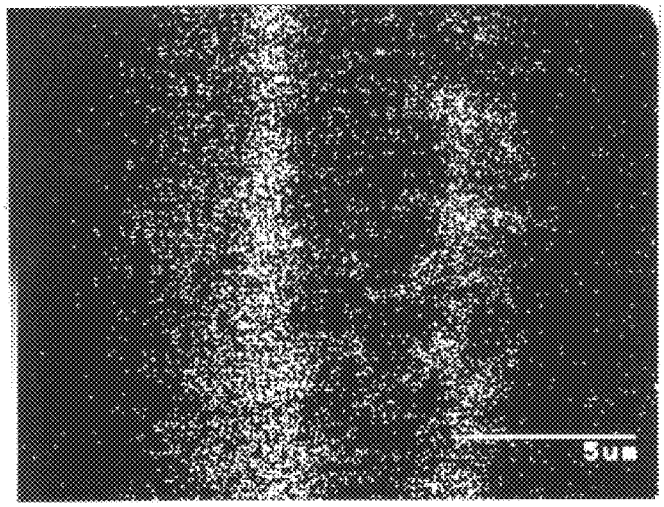

As shown in FIG. 3, the preferred structure according to the third aspect of the invention can include an overlap of the binder phase depleted region 5 and the WC-depleted region 6. Four compositional zones A, B. C, and D preferably result as follows:

[A]: (Ti, $W_xM_y$)($C_uN_{1-u}$)-WC (less than 2 vol. %)-CoNi (less than 2 vol. %)

[B]: (Ti, $W_xM_y$)($C_uN_{1-u}$)-WC (less than 2 vol. %)-CoNi

[C]: (Ti, $W_xM_y$)($C_uN_{1-u}$)-WC (gradually increases toward interior)-CoNi

[D]: (Ti, $W_xM_y$)($C_uN_{1-u}$)-WC-CoNi (alloy-average composition).

The aforementioned structure of the inventive alloy can be obtained by setting a sintering temperature in the range of 1350 to 1700° C. for a specified composition and controlling a sintering atmosphere and a cooling rate. The thicknesses of the three layers forming the exudation layer 1' can be adjusted by controlling the sintering temperature and the cooling rate.

The volume percentage of WC is measured by the following method. A section of a WC-Co cemented carbide member having a known WC content is lapped to take a SEM photograph of 4800 magnifications. An area occupied by WC in this photograph is calculated by an image analyzer, to draw a calibration curve on the area occupied by WC. As to the inventive alloy, a section of a portion to be observed is lapped and an area occupied by WC is calculated from an SEM photograph of 4800 magnifications by an image analyzer, for obtaining the volume percentage of WC from a calibration curve.

EXAMPLES OF THE INVENTION

Concrete Examples of the present invention will now be described.

Example 1

45 percent by weight of ($Ti_{0.85}Ta_{0.04}Nb_{0.04}W_{0.07}$)($C_{0.56}N_{0.44}$) powder of 2 μm in mean particle size having a cored structure including an outer portion appearing pure white and a core portion appearing jet-black in a reflecting electron microscopic image, 40 percent by weight of WC powder of 0.7 μm in mean particle size, 7 percent by weight of Ni powder of 1.5 μm in mean particle size and 8 percent by weight of Co powder of 1.5 μm in mean particle size were wet-blended with each other, and thereafter the mixture was stamped and degassed in a vacuum of $10^{-2}$ Torr at 1200° C. Thereafter the mixture was sintered under a nitrogen gas partial pressure of 30 Torr at 1450° C. for 1 hour, and then cooled in a vacuum at 5° C./min., to form a sample 1. The sample 1 had a Ti content of 34 percent by weight in terms of TiCN, a W content of 45 percent by weight in terms of WC, and a Ta and Nb content of 6 percent by weight in terms of TaC+Nb. The atomic ratio N/(C+N) was 0.3. Absolutely no WC particles were present in a region of 10 μm in thickness located immediately under a soft layer, and the abundance or proportional content of a hard phase containing WC was 15 percent by volume in the interior at a depth of 1 mm from the outermost surface.

For the purpose of comparison, samples 2 to 4 were prepared by conventional methods respectively. The sample 2 was prepared by sintering a stamped compact which was identical to that of the sample 1 under a nitrogen partial pressure of 5 Torr at 1400° C. The sample 3 was prepared by cooling a sintered body which was identical to that of the sample 2 under a CO partial pressure of 200 Torr after sintering. The sample 4 was prepared by cooling a sintered body which was identical to that of the sample 2 under a nitrogen partial pressure of 180 Torr after sintering.

In the samples 2 to 4, the proportional contents of hard phases containing WC located immediately under soft layers were 10 percent by volume, 15 percent by volume and 5 percent by volume respectively. In addition to raw materials which were identical to those for the sample 1, further, TaC, NbC, ZrC and VC of 1 to 3 μm in mean particle size were blended in weight ratios shown in Table 1 to form sintered alloys through steps similar to those for the sample 1, thereby preparing samples 5 to 10 having reduced or resultant contents shown in Table 1. Ni, Co, ZrC and VC were omitted from the right side columns of Table 1 since the reduced or resultant contents thereof were substantially identical to the blending compositions. Table 2 shows atomic ratios N/(C+N), thicknesses of layers having not more than 1 percent by volume of hard phases containing WC located immediately under soft layers in alloy surface regions, and the proportional contents of the hard phases containing WC in regions at a depth of 1 mm from the outermost surfaces.

TABLE 1

| Sample | Blending Composition (weight %) | | | | | | | | Reduced Content (weight %) | | |
|---|---|---|---|---|---|---|---|---|---|---|---|
| No. | (TiTaNbW)CN | WC | TaC | NbC | ZrC | VC | Ni | Co | TiCN | WC | TaC + NbC |
| 1 | | | | | | | | | | | |
| 2* | | | | | | | | | | | |
| 3* | 45 | 40 | — | — | — | — | 7 | 8 | 34 | 45 | 6 |
| 4* | | | | | | | | | | | |
| 5 | 30 | 40 | 4 | 4 | 2 | — | 5 | 15 | 22 | 45 | 11 |
| 6 | 60 | 20 | 3 | — | — | 2 | 10 | 5 | 44 | 30 | 9 |
| 7* | 80 | 2 | 2 | — | 2 | — | 7 | 7 | 58 | 15 | 11 |
| 8* | 89 | — | — | — | — | — | 5 | 6 | 65 | 14 | 10 |
| 9* | 50 | 40 | — | 2 | — | — | 4 | 4 | 37 | 48 | 7 |
| 10* | 45 | 25 | 2 | — | 2 | — | 13 | 13 | 3 | 32 | 7 |

Note)
Asterisks denote comparative samples, and underlined numeric values are out of the inventive ranges.

TABLE 2

| Sample No. | N/(C + N) (Atomic Ratio) | Thickness of Region Having Not More than 1 vol. % of Hard Phase Containing WC | Volume percentage of Hard Phase Containing WC Particles at Depth of 1 mm from Surface |
|---|---|---|---|
| 1 | 0.30 | 10 | 15 |
| 2* | 0.30 | 0 | 15 |
| 3* | 0.30 | 0 | 15 |
| 4* | 0.30 | 0 | 15 |
| 5 | 0.27 | 5 | 20 |
| 6 | 0.41 | 15 | 7 |
| 7* | 0.44 | 200 | 3 |
| 8* | 0.44 | Overall Alloy Region | 0 |
| 9* | 0.34 | 10 | 35 |
| 10* | 0.36 | 60 | 5 |

Note)
Asterisks denote comparative samples.

The nitrogen-containing sintered alloys of the aforementioned samples 1 to 10 were employed for cutting work under cutting conditions 1 to 3 shown in Table 3, to consequently obtain results shown in Table 4.

TABLE 3

| | Cutting Condition 1 (Wear Resistance Test) | Cutting Condition 2 (Toughness Test) | Cutting Condition 3 (Thermal Shock Resistance Test) |
|---|---|---|---|
| Tool Shape | TNMG332 | SNMG432 | SNMG432 |
| Workpiece | SCM435 ($H_B$ = 350) Round Bar | SCM435 ($H_B$ = 250) Round Bar with Four Longitudinal Flutes | SCM435 ($H_B$ = 220) Round Bar |
| Cutting Speed | 150 m/min. | 100 m/min. | 250 m/min. |

TABLE 3-continued

| | Cutting Condition 1 (Wear Resistance Test) | Cutting Condition 2 (Toughness Test) | Cutting Condition 3 (Thermal Shock Resistance Test) |
|---|---|---|---|
| Feed Rate | 0.36 mm/rev. | 0.24 mm/rev. | 0.20 mm/rev. |
| Depth of Cut | 1.5 mm | 2.0 mm | Changed from 2.5 to 0.2 mm |

TABLE 3-continued

| | Cutting Condition 1 (Wear Resistance Test) | Cutting Condition 2 (Toughness Test) | Cutting Condition 3 (Thermal Shock Resistance Test) |
|---|---|---|---|
| Cutting Oil | Water Soluble | Not Used | Water Soluble |
| Cutting Time | 30 min. | 30 sec. | 15 min. |
| Determination | Flank Wear Width (mm) | Number of Chipped Ones among 20 Inserts | Number of Chipped Ones among 20 Inserts |

TABLE 4

| Sample No. | | Cutting Condition 1 Flank Wear Width (mm) | Cutting Condition 2 Number of Chipped Ones among 20 Inserts | Cutting Condition 3 Number of Chipped Ones among 20 Inserts |
|---|---|---|---|---|
| Inventive Sample | 1 | 0.14 | 4 | 2 |
| Comparative Sample | 2 | 0.25 | 10 | 20 |
| | 3 | 0.34 | 10 | 18 |
| | 4 | 0.35 | 12 | 6 |
| Inventive Sample | 5 | 0.16 | 3 | 5 |
| | 6 | 0.11 | 6 | 3 |
| Comparative Sample | 7 | 0.15 | 16 | 20 |
| | 8 | 0.28 | 15 | 16 |
| | 9 | 0.11 | 18 | 9 |
| | 10 | 0.58 | 6 | 10 |

As understood from the results shown in Table 4, the samples 1, 5 and 6 having compositions etc. satisfying the conditions according to the first or second aspect of the present invention are superior in wear resistance, toughness and thermal shock resistance as compared to the samples 2 to 4 and 7 to 10 having compositions etc. that are out of the inventive conditions.

Example 2

Raw powder materials shown in Table 5 were blended and mixed and crushed to attain respective reduced or resultant contents, thereby forming samples 11 to 23. Each TiCN powder material had a mean particle size size of 2 μm and an atomic ratio C/N of 5/5, while the remaining powder materials were 1 to 3 μm in mean particle size. The sample 12 was prepared with a Ta and Nb source of (TaNb)C powder (TaC:NbC=2:1 (weight ratio)) of 1.5 μm in mean particle size, while the sample 17 was prepared with a Ti and W source of $(Tio_{0.8}W_{0.2})(C_{0.7}N_{0.3})$ of 2 μm in mean particle size. Table 5 shows the amounts of blending of these solid solution raw powder materials in terms of single compounds. Blending compositions of the respective samples were omitted from Table 5 since the same were substantially identical to the reduced contents.

TABLE 5

| | Reduced Content (wt. %) | | | | | | | | | | |
|---|---|---|---|---|---|---|---|---|---|---|---|
| Sample No. | TiCN | TiC | TiN | WC | $Mo_2C$ | TaC | NbC | ZrC | HfC | Ni | Co |
| 11 | 45 | — | — | 35 | 5 | — | — | — | — | 5 | 10 |
| 12 | 40 | — | — | 30 | 5 | 4 | 2 | 2 | 2 | 5 | 10 |
| 13 | — | 15 | 21 | 44 | — | — | — | — | — | 10 | 10 |
| 14 | — | 10 | 16 | 44 | — | — | 7 | 3 | — | 10 | 10 |
| 15 | — | 23 | 12 | 50 | — | — | — | — | — | 8 | 7 |
| 16 | — | 10 | 25 | 50 | — | — | — | — | — | 8 | 7 |
| 17 | — | 26 | 17 | 37 | 3 | 3 | — | — | — | 6 | 8 |
| 18* | 55 | — | — | 25 | — | 4 | — | — | — | 8 | 8 |
| 19* | 18 | — | — | 72 | — | — | — | — | — | 5 | 5 |
| 20* | — | 25 | 10 | 50 | — | — | — | — | — | 8 | 7 |
| 21* | — | 7 | 28 | 50 | — | — | — | — | — | 8 | 7 |
| 22* | 40 | — | 5 | 35 | — | — | — | 3 | 3 | 6 | 8 |
| 23* | 30 | — | 5 | 35 | — | 10 | 6 | — | — | 6 | 8 |

Note) Asterisks denote comparative samples, and underlined numeric values are out of the inventive ranges.

The samples 11 to 23 were heated in a vacuum of $10^{-2}$ Torr at 3° C./min., degassed at 1200° C. for 15 minutes, thereafter sintered nitrogen gas partial pressure of 15 to 40 Torr at 1450° C. for 1 hour, thereafter control-cooled in a vacuum to 1200° C. at 3° C./min., and thereafter nitrogen-quenched. As to the samples 11 and 12, samples 11A to 11C and 12A to 12C were formed after sintering under the same conditions, under various cooling conditions The samples 11A and 12A were cooled under a CO partial pressure of 150 Torr after sintering under the same conditions as the samples 11 and 12 respectively, the samples 11B and 12B were cooled under a nitrogen partial pressure of 200 Torr, and the samples 11C and 12C were heated to 1530° C., thereafter sintered for 1.5 hours, and thereafter control-cooled.

Table 6 shows atomic ratios N/(C+N), thicknesses of regions having not more than 1 percent by volume of hard phases containing WC located immediately under soft layers in alloy surface regions, and the proportional contents of the hard phases containing WC in regions at a depth of 1 mm from outermost surfaces as to the samples 11 to 23, 11A to 11C and 12A to 12C.

TABLE 6

| Sample No. | N/(C + N) (Atomic Ratio) | Thickness of Region Having Not More than 1 vol. % of Hard Phase Containing WC (μm) | Content of Hard Phase Containing WC in Region at Depth of 1 mm from Surface (vol. %) |
|---|---|---|---|
| 11 | 0.39 | 8 | 12 |
| 11A* | " | 2 | 20 |
| 11B* | " | 35 | 15 |
| 11C* | " | 8 | 3 |
| 12 | 0.37 | 15 | 8 |
| 12A* | " | 0 | 15 |
| 12B* | " | 50 | 10 |
| 12C* | " | 15 | 3 |
| 13 | 0.42 | 10 | 26 |
| 14 | 0.35 | 5 | 15 |
| 15 | 0.23 | 17 | 22 |
| 16 | 0.48 | 8 | 35 |
| 17 | 0.29 | 15 | 24 |

TABLE 6-continued

| Sample No. | N/(C + N) (Atomic Ratio) | Thickness of Region Having Not More than 1 vol. % of Hard Phase Containing WC (μm) | Content of Hard Phase Containing WC in Region at Depth of 1 mm from Surface (vol. %) |
|---|---|---|---|
| 18* | 0.43 | OverallAlloyRegion | 0 |
| 19* | 0.22 | 0 | 60 |
| 20* | 0.19 | 23 | 18 |
| 21* | 0.54 | 3 | 40 |
| 22* | 0.43 | 8 | 12 |
| 23 | 0.38 | 9 | 14 |

Note)
Asterisks denote comparative samples, and underlined numeric values are out of the inventive ranges.

The samples shown in Table 6 were employed for cutting work under cutting conditions 4 to 6 shown in Table 7, to obtain results shown in in Table 8. For the purpose of comparison, a commercially available coated cemented carbide (grade P10) was also subjected to a cutting test.

TABLE 7

| | Cutting Condition 4 (Wear Resistance Test) | Cutting Condition 5 (Toughness Test) | Cutting Condition 6 (Milling Cutter Thermal Shock Resistance Test) |
|---|---|---|---|
| Tool Shape | TNMG332 | SNMG432 | SDKN42 |
| Workpiece | SCM435 ($H_B$ = 250) Round Bar | SCM435 ($H_B$ = 250) Round Bar with Four Longitudinal Flutes | SCM435 ($H_B$ = 240) Plate with Three Longitudinal Flutes (Flute of 5 mm in Width Every 20 mm) |
| Cutting Speed | 180 m/min. | 150 m/min. | 160 m/min. |
| Feed Rate | 0.3 mm/rev. | 0.2 mm/rev. | 0.28 mm/rev. |
| Depth of Cut | 1.5 mm | 2.0 mm | 0.2 mm |
| Cutting Oil | Water Soluble | Not Used | Water Soluble |
| Cutting Time | 20 min. | 30 sec. | 5 Passes |
| Determination | Flank Wear Width (mm) | Number of Chipped Ones among 20 Inserts | Number of Inserts Chipped by Thermal Cracking etc. among 20 Ones |

TABLE 8

| Sample No. | | Cutting Condition 4 Flank Wear Width (mm) | Cutting Condition 5 Number of Chipped Ones among 20 Inserts | Cutting Condition 6 Number of Chipped Ones among 20 Inserts |
|---|---|---|---|---|
| Inventive Sample | 11 | 0.15 | 5 | 4 |
| Comparative Sample | 11A | exceeded 0.8 mm in 12 min. | 9 | 10 |
| | 11B | 0.28 | 11 | 13 |
| | 11C | 0.22 | 14 | 17 |
| Inventive Sample | 12 | 0.12 | 7 | 3 |
| Comparative Sample | 12A | 0.41 | 5 | 10 |
| | 12B | 0.18 | 15 | 12 |
| | 12C | 0.16 | 17 | 14 |
| Inventive Sample | 13 | 0.20 | 8 | 8 |
| | 14 | 0.15 | 7 | 6 |
| | 15 | 0.13 | 8 | 5 |
| | 16 | 0.18 | 9 | 8 |
| | 17 | 0.12 | 7 | |
| Comparative Sample | 18 | 0.13 | 20 | 20 |
| | 19 | exceeded 0.8 mm in 5 min. | 8 | 12 |
| | 20 | 0.12 | 13 | 14 |
| | 21 | 0.25 | 16 | 18 |
| | 22 | 0.14 | 18 | 12 |
| | 23 | chipped in 10 min. | 20 | 11 |
| | Coated Cemented Carbide (Grade P10) | 0.15 | 7 | 4 |

As understood from the results shown in Table 8, the samples 11, 12 and 13 to 17 having compositions etc. satisfying the conditions according to the first or second aspect of the present invention are superior in wear resistance, toughness and thermal shock resistance to the samples 11A to 11C, 12A to 12C and 18 to 23 having compositions etc. that are out of the inventive conditions.

Example 3

TiCN powder, WC powder, TaC powder, NbC powder, $Mo_2C$ powder, VC powder, $(Ti_{0.5}W_{0.3}Ta_{0.1}Nb_{0.1})C_{0.5}N_{0.5}$ powder, Co powder and Ni powder of 1.5 $\mu$m in mean particle size were blended into a composition shown at A in Table 9, mixed with each other in a wet attriter for 12 hours, and thereafter worked into green compacts of a CNMG432 shape under a pressure of 1.5 ton/cm$^2$. The green compacts were honed to thereafter prepare sintered alloys having structures shown in Tables 11 to 13 under sintering conditions shown in Table 10. Referring to tables 11 to 13, the columns labelled "structure relative to depth measured from boundary immediately under exudation layer toward interior" show the composition ratios of the hard phase and the binder phase for each sample as the ratios varied with depth measured toward the interior of the respective alloy with reference to the boundary immediately under the exudation layer, which is designated as zero depth. In a sample a-7, for example, the WC content is uniform and identical to the alloy-average WC volume percentage from immediately under the exudation layer toward the interior, while the binder phase content is 1.8 percent by volume up to 2.5 $\mu$m, gradually increased from 2.5 $\mu$m up to 60 $\mu$m, and identical to the alloy-average binder phase volume percentage in an internal portion beyond 60 $\mu$m. The content of the hard phase forming the remainder is expressed as 100—(alloy-average binder phase volume percentage)—(alloy-average WC volume percentage) at each depth.

TABLE 9

| | Blending Composition (wt. %) | Binder Phase |
|---|---|---|
| | Hard Phase Component | Component |
| A | TiCN 46% WC 40% | Co 7% Ni 7% |
| B | TiCN 41% WC 30% TaC 5% NbC 5% $Mo_2C$ 3% VC 2% | Co 7% Ni 7% |
| C | $(Ti_{0.5}, W_{0.3}, Ta_{0.1}, Nb_{0.1})(C_{0.5}, N_{0.5})$ 86% | Co 7% Ni 7% |
| D | TiCN 66% WC 16% | Co 9% Ni 9% |

TABLE 10

| | Sintering Condition | | | |
|---|---|---|---|---|
| Sintering No. | Sintering Temperature (° C.) | Sintering Atmosphere (Torr) | Cooling Rate (° C./min) | Cooling Atmosphere (Torr) |
| 1 | 1530 | Nitrogen: 5 | 8 | Nitrogen: 3 |
| 2 | 1520 | Nitrogen: 50 | 2 | Nitrogen: 4 |
| 3 | 1400 | Nitrogen: 3 | 4 | Nitrogen: 4 |
| 4 | 1460 | Nitrogen: 6 | 2 | Nitrogen: 5 |
| 5 | 1460 | Nitrogen: 10 | 2 | Nitrogen: 10 |
| 6 | 1420 | Nitrogen: 5 | 1 | Nitrogen: 12 |
| 7 | 1435 | Nitrogen: 6 | 4 | Vacuum |
| 8 | 1530 | Nitrogen: 5 | 8 | Vacuum |
| 9 | 1520 | Nitrogen: 2 | 2 | Methane: 2 |
| 10 | 1400 | Nitrogen: 50 | 4 | Methane: 1 |
| 11 | 1460 | Nitrogen: 6 | 2 | Methane: 2 |
| 12 | 1420 | Nitrogen: 5 | 1 | Argon: 2 |
| 13 | 1435 | Nitrogen: 6 | 4 | Argon: 5 |
| 14 | 1530 | Nitrogen: 5 | 8 | Vacuum |
| 15 | 1420 | Nitrogen: 10 | 1 | Vacuum |

TABLE 11

| Sample No. | Raw Material Grade Powder | Sintering No. | Exudation Layer Structure Outermost Layer | Intermediate Layer | Innermost Layer | Structure Relative to Depth Measured From Boundary Immediately Under Exudation Layer Toward Interior |
|---|---|---|---|---|---|---|
| a-1 | A | 1 | No | No | No | Binder Phase: Alloy-Average Volume Percentage from Surface Boundary to Interior WC: Alloy-Average Volume Percentage from Surface Boundary to Interior Hard Phase: Remainder |
| a-2 | A | 2 | Binder Phase (Co + Ni) 2 μm 90 vol. % | WC 5 μm 59 vol. % | Binder Phase (Co + Ni) 2 μm 90 vol. % | Binder Phase: Alloy-Average Volume Percentage from Surface Boundary to Interior WC: Alloy-Average Volume Percentage from Surface Boundary to Interior Hard Phase: Remainder |
| a-3 | A | 3 | Binder Phase (Co + Ni) 12 μm 90 vol. % | WC 5 μm 59 vol. % | Binder Phase (Co + Ni) 12 μm 90 vol. % | Binder Phase: Alloy-Average Volume Percentage from Surface Boundary to Interior WC: Alloy-Average Volume Percentage from Surface Boundary to Interior Hard Phase: Remainder |
| a-4 | A | 4 | Binder Phase (Co + Ni) 5 μm 90 vol. % | WC 12 μm 80 vol. % | Binder Phase (Co + Ni) 5 μm 90 vol. % | Binder Phase: Alloy-Average Volume Percentage from Surface Boundary to Interior WC: Alloy-Average Volume Percentage from Surface Boundary to Interior Hard Phase: Remainder |
| a-5 | A | 5 | Binder Phase (Co + Ni) 3 μm 90 vol. % | WC 6 μm 48 vol. % | Binder Phase (Co + Ni) 3 μm 90 vol. % | Binder Phase: Alloy-Average Volume Percentage from Surface Boundary to Interior WC: Alloy-Average Volume Percentage from Surface Boundary to Interior Hard Phase: Remainder |
| a-6 | A | 6 | Binder Phase (Co + Ni) 3 μm 90 vol. % | WC 6 μm 98 vol. % | Binder Phase (Co + Ni) 3 μm 90 vol. % | Binder Phase: Alloy-Average Volume Percentage from Surface Boundary to Interior WC: Alloy-Average Volume Percentage from Surface Boundary to Interior Hard Phase: Remainder |

35

TABLE 12

| Sample No. | Raw Material Grade Powder | Sintering No. | Exudation Layer Structure Outermost Layer | Intermediate Layer | Innermost Layer | Structure Relative to Depth Measured From Boundary Immediately Under Exudation Layer Toward Interior |
|---|---|---|---|---|---|---|
| a-7 | A | 7 | Binder Phase (Co + Ni) 3 μm 90 vol. % | WC 6 μM 90 vol. % | Binder Phase (Co + Ni) 3 μm 90 vol. % | Binder Phase: 1.8 vol. % up to 2.5 μm, thereafter gradually increased, Alloy-Average Volume Percentage at 60 μm WC: Alloy-Average Volume Percentage from Surface Boundary to Interior Hard Phase: Remainder |
| a-8 | A | 8 | Binder Phase (Co + Ni) 3 μm 90 vol. % | WC 6 μM 90 vol. % | Binder Phase (Co + Ni) 3 μm 90 vol. % | Binder Phase: 1.8 vol. % up to 98 μm, thereafter gradually increased, Alloy-Average Volume Percentage at 200 μm WC: Alloy-Average Volume Percentage from Surface Boundary to Interior Hard Phase: Remainder |
| a-9 | A | 9 | Binder Phase (Co + Ni) 3 μm 90 vol. % | WC 6 μM 90 vol. % | Binder Phase (Co + Ni) 3 μm 90 vol. % | Binder Phase: 1.5 vol. % up to 1 μm, thereafter gradually increased, Alloy-Average Volume Percentage at 20 μm WC: Alloy-Average Volume Percentage from Surface Boundary to Interior Hard Phase: Remainder |
| a-10 | A | 10 | Binder Phase (Co + Ni) 3 μm 90 vol. % | WC 6 μM 90 vol. % | Binder Phase (Co + Ni) 3 μm 90 vol. % | Binder Phase: 1.2 vol. % up to 105 μm, thereafter gradually increased, Alloy-Average Volume Percentage at 320 μm |

TABLE 12-continued

| Sample No. | Raw Material Grade Powder | Sintering No. | Exudation Layer Structure Outermost Layer | Intermediate Layer | Innermost Layer | Structure Relative to Depth Measured From Boundary Immediately Under Exudation Layer Toward Interior |
|---|---|---|---|---|---|---|
| | | | | | | WC: Alloy-Average Volume Percentage from Surface Boundary to Interior Hard Phase: Remainder |
| a-11 | A | 11 | Binder Phase (Co + Ni) 3 μm 90 vol. % | WC 6 μM 90 vol. % | Binder Phase (Co + Ni) 3 μm 90 vol. % | Binder Phase: Alloy-Average Volume Percentage from Surface Boundary to Interior WC: 1.8 vol. % up to 1.8 μm, thereafter gradually increased, Alloy-Average Volume Percentage at 250 μm Hard Phase: Remainder |
| a-12 | A | 12 | Binder Phase (Co + Ni) 3 μm 90 vol. % | WC 6 μM 90 vol. % | Binder Phase (Co + Ni) 3 μm 90 vol. % | Binder Phase: Alloy-Average Volume Percentage from Surface Boundary to Interior WC: 1.8 vol. % up to 498 μm, thereafter gradually increased, Alloy-Average Volume Percentage at 700 μm Hard Phase: Remainder |

TABLE 13

| Sample No. | Raw Material Grade Powder | Sintering No. | Exudation Layer Structure Outermost Layer | Intermediate Layer | Innermost Layer | Structure Relative to Depth Measured From Boundary Immediately Under Exudation Layer Toward Interior |
|---|---|---|---|---|---|---|
| a-13 | A | 13 | Binder Phase (Co + Ni) 3 μm 90 vol. % | WC 6 μM 90 vol. % | Binder Phase (Co + Ni) 3 μm 90 vol. % | Binder Phase: Alloy-Average Volume Percentage from Surface Boundary to Interior WC: 3 vol. % at Surface Boundary thereafter gradually increased, Alloy-average Volume Percentage at 60 μm Hard Phase: Remainder |
| a-14 | A | 14 | Binder Phase (Co + Ni) 3 μm 90 vol. % | WC 6 μM 90 vol. % | Binder Phase (CO + Ni) 3 μm 90 vol. % | Binder Phase: Alloy-Average Volume Percentage from Surface Boundary to Interior WC: 1.8 vol. % up to 600 μm, thereafter gradually increased, Alloy-Average Volume Percentage at 900 μm Hard Phase: Remainder |
| a-15 | A | 15 | Binder Phase (Co + Ni) 3 μm 90 vol. % | WC 6 μM 90 vol. % | Binder Phase (Co + Ni) 3 μm 90 vol. % | Binder Phase: 1.8 vol. % up to 2.5 μm, thereafter gradually increased, Alloy-Average Volume Percentage at 60 μm WC: 1.8 vol. % up to 1.8 μm, thereafter gradually increased, Alloy-average Volume Percentage at 250 μm Hard Phase: Remainder |

The samples a-1 to a-15 were subjected to a thermal shock resistance test and a wear resistance test under conditions (A) and (B) respectively. Table 14 shows the results.

(A)

Workpiece: SCM435 (HB: 250) with four flutes

Cutting Speed: 100 (m/min.)

Depth of Cut: 1.5 (mm)

Feed Rate: 0.20 (mm/rev.)

Cutting Time: 30 sec.

Wet Type (B)

Workpiece: SCM435 (HB: 250) with four flutes

Cutting Speed; 180 (m/min.)

Depth of Cut: 1.5 (mm)

Feed rate: 0.30 (mm/rev.)

Cutting Time: 20 min.

Wet Type:

TABLE 14

| Sample | (A) | (B) |
|---|---|---|
| a-1 | 38 Inserts | 0.29 mm |
| *a-2 | 16 Inserts | 0.19 mm |
| a-3 | 36 Inserts | 0.30 mm |
| a-4 | 37 Inserts | 0.31 mm |
| a-5 | 38 Inserts | 0.29 mm |
| *a-6 | 16 Inserts | 0.25 mm |
| *a-7 | 10 Inserts | 0.10 mm |
| *a-8 | 10 Inserts | 0.08 mm |
| *a-9 | 11 Inserts | 0.18 mm |
| *a-10 | 19 Inserts | 0.08 mm |
| *a-11 | 10 Inserts | 0.19 mm |
| *a-12 | 10 Inserts | 0.18 mm |

TABLE 14-continued

| Sample | (A) | (B) |
|---|---|---|
| *a-13 | 12 Inserts | 0.23 mm |
| *a-14 | 17 Inserts | 0.18 mm |
| *a-15 | 5 Inserts | 0.07 mm |

*inventive samples
(A): number of chipped ones among 40 inserts
(B): flank wear width It is understood that thermal shock resistance superior to that of the prior art can be attained when a sintered alloy having a hard phase consisting of TiCN and WC is provided with an exudation layer as specified. It is also understood that wear resistance and thermal shock resistance are improved respectively when binder phase and WC distributions as specified are provided.

Example 4

Raw powder materials identical to those of Example 3 were blended into a composition shown at B in Table 9, worked into green compacts by a method identical to that in Example 3, and the green compacts were honed to prepare sintered alloys having structures shown in Tables 15 to 17 under the sintering conditions shown in Table 10. Samples b-1 to b-15 were subjected to a thermal shock resistance test and a wear resistance test under conditions (C) and (D) respectively. Table 18 shows the results.

(C)

Workpiece: SCM435 (HB: 300) with four flutes

Cutting Speed: 120 (m/min.)

Depth of Cut: 1.5 (mm)

Feed Rate: 0.20 (mm/rev.)

Cutting Time: 30 sec.

Wet Type (D)

Workpiece: SCM435 (HB: 300) with four flutes

Cutting Speed: 200 (m/min.)

Depth of cut 1.5 (mm)

Feed rate: 0.30 (mm/rev.)

Cutting Time: (20 min.)

Wet Type

TABLE 15

| Sample No. | Raw Material Grade Powder | Raw Material Sintering No. | Exudation Layer Structure: Outermost Layer | Exudation Layer Structure: Intermediate Layer | Exudation Layer Structure: Innermost Layer | Structure Relative to Depth Measured: From Boundary Immediately Under Exudation Layer Toward Interior |
|---|---|---|---|---|---|---|
| b-1 | B | 1 | No | No | No | Binder Phase: Alloy-Average Volume Percentage from Surface Boundary to Interior<br>WC: Alloy-Average Volume Percentage from Surface Boundary to Interior<br>Hard Phase: Remainder |
| b-2 | B | 2 | Binder Phase (Co + Ni)<br>3 μm<br>90 vol. % | WC<br>7 μm<br>70 vol. % | Binder Phase (Co + Ni)<br>3 μm<br>90 vol. % | Binder Phase: Alloy-Average Volume Percentage from Surface Boundary to Interior<br>WC: Alloy-Average Volume Percentage from Surface Boundary to Interior<br>Hard Phase: Remainder |
| b-3 | B | 3 | Binder Phase (Co + Ni)<br>12 μm<br>90 vol. % | WC<br>3 μm<br>61 vol. % | Binder Phase (Co + Ni)<br>12 μm<br>90 vol. % | Binder Phase: Alloy-Average Volume Percentage from Surface Boundary to Interior<br>WC: Alloy-Average Volume Percentage from Surface Boundary to Interior<br>Hard Phase: Remainder |
| b-4 | B | 4 | Binder Phase (Co + Ni)<br>5 μm<br>90 vol. % | WC<br>12 μm<br>80 vol. % | Binder Phase (Co + Ni)<br>5 μm<br>90 vol. % | Binder Phase: Alloy-Average Volume Percentage from Surface Boundary to Interior<br>WC: Alloy-Average Volume Percentage from Surface Boundary to Interior<br>Hard Phase: Remainder |
| b-5 | B | 5 | Binder Phase (Co + Ni)<br>3 μm<br>90 vol. % | WC<br>7 μm<br>48 vol. % | Binder Phase (Co + Ni)<br>3 μm<br>90 vol. % | Binder Phase: Alloy-Average Volume Percentage from Surface Boundary to Interior<br>WC: Alloy-Average Volume Percentage from Surface Boundary to Interior<br>Hard Phase: Remainder |
| b-6 | B | 6 | Binder Phase (Co + Ni)<br>3 μm<br>90 vol. % | WC<br>5 μm<br>98 vol. % | Binder Phase (Co + Ni)<br>3 μm<br>90 vol. % | Binder Phase: Alloy-Average Volume Percentage from Surface Boundary to Interior<br>WC: Alloy-Average Volume Percentage from Surface Boundary to Interior<br>Hard Phase: Remainder |

TABLE 16

| Sample No. | Raw Material Grade Powder | Sintering No. | Exudation Layer Structure: Outermost Layer | Exudation Layer Structure: Intermediate Layer | Exudation Layer Structure: Innermost Layer | Structure Relative to Depth Measured: From Boundary Immediately Under Exudation Layer Toward Interior |
|---|---|---|---|---|---|---|
| b-7 | B | 7 | Binder Phase (Co + Ni)<br>3 μm<br>90 vol. % | WC<br>7 μM<br>90 vol. % | Binder Phase (Co + Ni)<br>3 μm<br>90 vol. % | Binder Phase: 1.8 vol. % up to 2.5 μm,<br>thereafter gradually increased,<br>Alloy-Average Volume Percentage at 60 μm<br>WC: Alloy-Average Volume Percentage<br>from Surface Boundary to Interior<br>Hard Phase: Remainder |
| b-8 | B | 8 | Binder Phase (Co + Ni)<br>3 μm<br>90 vol. % | WC<br>7 μM<br>90 vol. % | Binder Phase (Co + Ni)<br>3 μm<br>90 vol. % | Binder Phase: 1.8 vol. % up to 98 μm,<br>thereafter gradually increased,<br>Alloy-Average Volume Percentage at 200 μm<br>WC: Alloy-Average Volume Percentage<br>from Surface Boundary to Interior<br>Hard Phase: Remainder |
| b-9 | B | 9 | Binder Phase (Co + Ni)<br>3 μm<br>90 vol. % | WC<br>7 μM<br>90 vol. % | Binder Phase (Co + Ni)<br>3 μm<br>90 vol. % | Binder Phase: 1.5 vol. % up to 1 μm,<br>thereafter gradually increased,<br>Alloy-Average Volume Percentage at 20 μm<br>WC: Alloy-Average Volume Percentage<br>from Surface Boundary to Interior<br>Hard Phase: Remainder |
| b-10 | B | 10 | Binder Phase (Co + Ni)<br>3 μm<br>90 vol. % | WC<br>7 μM<br>90 vol. % | Binder Phase (Co + Ni)<br>3 μm<br>90 vol. % | Binder Phase: 1.2 vol. % up to 105 μm,<br>thereafter gradually increased,<br>Alloy-Average Volume Percentage at 320 μm<br>WC: Alloy-Average Volume Percentage<br>from Surface Boundary to Interior<br>Hard Phase: Remainder |
| b-11 | B | 11 | Binder Phase (Co + Ni)<br>3 μm<br>90 vol. % | WC<br>7 μM<br>90 vol. % | Binder Phase (Co + Ni)<br>3 μm<br>90 vol. % | Binder Phase: Alloy-Average Volume Percentage<br>from Surface Boundary to Interior<br>WC: 1.8 vol. % up to 1.8 μm,<br>thereafter gradually increased,<br>Alloy-Average Volume Percentage at 250 μm<br>Hard Phase: Remainder |
| b-12 | B | 12 | Binder Phase (Co + Ni)<br>3 μm<br>90 vol. % | WC<br>7 μM<br>90 vol. % | Binder Phase (Co + Ni)<br>3 μm<br>90 vol. % | Binder Phase: Alloy-Average Volume Percentage<br>from Surface Boundary to Interior<br>WC: 1.8 vol. % up to 498 μm,<br>thereafter gradually increased,<br>Alloy-Average Volume Percentage at 700 μm<br>Hard Phase: Remainder |

TABLE 17

| Sample No. | Raw Material Grade Powder | Sintering No. | Exudation Layer Structure: Outermost Layer | Exudation Layer Structure: Intermediate Layer | Exudation Layer Structure: Innermost Layer | Structure Relative to Depth Measured: From Boundary Immediately Under Exudation Layer Toward Interior |
|---|---|---|---|---|---|---|
| b-13 | B | 13 | Binder Phase (Co + Ni)<br>3 μm<br>90 vol. % | WC<br>7 μM<br>90 vol. % | Binder Phase (Co + Ni)<br>3 μm<br>90 vol. % | Binder Phase: Alloy-Average Volume Percentage<br>from Surface Boundary to Interior<br>WC: 4 vol. % at Surface Boundary,<br>thereafter gradually increased,<br>Alloy-Average Volume Percentage at 60 μm<br>Hard Phase: Remainder |
| b-14 | B | 14 | Binder Phase (Co + Ni)<br>3 μm<br>90 vol. % | WC<br>7 μM<br>90 vol. % | Binder Phase (CO + Ni)<br>3 μm<br>90 vol. % | Binder Phase: Alloy-Average Volume Percentage<br>from Surface Boundary to Interior<br>WC: 1.8 vol. % up to 600 μm,<br>thereafter gradually increased,<br>Alloy-Average Volume Percentage at 900 μm<br>Hard Phase: Remainder |
| b-15 | B | 15 | Binder Phase (Co + Ni)<br>3 μm<br>90 vol. % | WC<br>7 μM<br>90 vol. % | Binder Phase (Co + Ni)<br>3 μm<br>90 vol. % | Binder Phase: 1.7 vol. % up to 2.5 μm,<br>thereafter gradually increased,<br>Alloy-Average Volume Percentage at 60 μm<br>WC: 1.8 vol. % up to 1.8 μm,<br>thereafter gradually increased,<br>Alloy-average Volume Percentage at 250 μm<br>Hard Phase: Remainder |

TABLE 18

| Sample | (C) | (D) |
|---|---|---|
| b-1 | 39 Inserts | 0.31 mm |
| *b-2 | 15 Inserts | 0.17 mm |
| *b-3 | 37 Inserts | 0.32 mm |
| b-4 | 38 Inserts | 0.33 mm |
| b-5 | 39 Inserts | 0.31 mm |
| *b-6 | 15 Inserts | 0.23 mm |
| *b-7 | 9 Inserts | 0.08 mm |
| *b-8 | 9 Inserts | 0.06 mm |
| *b-9 | 10 Inserts | 0.15 mm |
| *b-10 | 18 Inserts | 0.05 mm |
| *b-11 | 9 Inserts | 0.16 mm |
| *b-12 | 9 Inserts | 0.15 mm |
| *b-13 | 11 Inserts | 0.20 mm |
| *b-14 | 16 Inserts | 0.15 mm |
| *b-15 | 4 Inserts | 0.04 mm |

*inventive samples
(C): number of chipped ones among 40 inserts
(D): flank wear width It is understood that thermal shock resistance superior to that of the prior art can be attained when a sintered alloy having a hard phase consisting of an element belonging to the group 4A, 5A or 6A is provided with an exudation layer as specified. It is also understood that wear resistance and thermal shock resistance are improved respectively when binder phase and WC distributions as specified are provided.

Example 5

Raw powder materials identical to those of Example 3 were blended into a composition shown at C in Table 9, worked into green compacts by a method identical to that in Example 3, and the green compacts were honed to prepare sintered alloys having structures shown in Tables 19 to 21 under the sintering conditions shown in Table 10. Samples c-1 to c-15 were subjected to a thermal shock resistance test and a wear resistance test under conditions (E) and (F) respectively. Table 22 shows the results.

(E)
Workpiece: SCM435 (HB: 280) with four flutes
Cutting Speed: 120 (m/min.)
Depth of Cut: 1.5 (mm)
Feed Rate: 0.20 (mm/rev.)
Cutting Time: 30 sec.
Wet Type (F)
Workpiece: SCM435 (HB: 280)
Cutting Speed: 200 (m/min.)
Depth of Cut: 1.5 (mm)
Feed Rate: 0.30 (mm/rev.)
Cutting Time: 20 min.
Wet Type

TABLE 19

| Sample No. | Raw Material Grade Powder | Raw Material Sintering No. | Exudation Layer Structure: Outermost Layer | Exudation Layer Structure: Intermediate Layer | Exudation Layer Structure: Innermost Layer | Structure Relative to Depth Measured: From Boundary Immediately Under Exudation Layer Toward Interior |
|---|---|---|---|---|---|---|
| c-1 | C | 1 | No | No | No | Binder Phase: Alloy-Average Volume Percentage from Surface Boundary to Interior<br>WC: Alloy-Average Volume Percentage from Surface Boundary to Interior<br>Hard Phase: Remainder |
| c-2 | C | 2 | Binder Phase (Co + Ni)<br>3 μm<br>90 vol. % | WC<br>7 μm<br>70 vol. % | Binder Phase (Co + Ni)<br>3 μm<br>90 vol. % | Binder Phase: Alloy-Average Volume Percentage from Surface Boundary to Interior<br>WC: Alloy-Average Volume Percentage from Surface Boundary to Interior<br>Hard Phase: Remainder |
| c-3 | C | 3 | Binder Phase (Co + Ni)<br>12 μm<br>90 vol. % | WC<br>3 μm<br>61 vol. % | Binder Phase (Co + Ni)<br>12 μm<br>90 vol. % | Binder Phase: Alloy-Average Volume Percentage from Surface Boundary to Interior<br>WC: Alloy-Average Volume Percentage from Surface Boundary to Interior<br>Hard Phase: Remainder |
| c-4 | C | 4 | Binder Phase (Co + Ni)<br>5 μm<br>90 vol. % | WC<br>12 μm<br>80 vol. % | Binder Phase (Co + Ni)<br>5 μm<br>90 vol. % | Binder Phase: Alloy-Average Volume Percentage from Surface Boundary to Interior<br>WC: Alloy-Average Volume Percentage from Surface Boundary to Interior<br>Hard Phase: Remainder |
| c-5 | C | 5 | Binder Phase (Co + Ni)<br>3 μm<br>90 vol. % | WC<br>7 μm<br>48 vol. % | Binder Phase (Co + Ni)<br>3 μm<br>90 vol. % | Binder Phase: Alloy-Average Volume Percentage from Surface Boundary to Interior<br>WC: Alloy-Average Volume Percentage from Surface Boundary to Interior<br>Hard Phase: Remainder |
| c-6 | C | 6 | Binder Phase (Co + Ni)<br>3 μm<br>90 vol. % | WC<br>7 μm<br>48 vol. % | Binder Phase (Co + Ni)<br>3 μm<br>90 vol. % | Binder Phase: Alloy-Average Volume Percentage from Surface Boundary to Interior<br>WC: Alloy-Average Volume Percentage from Surface Boundary to Interior<br>Hard Phase: Remainder |

TABLE 20

| Sample No. | Raw Material Grade Powder | Sintering No. | Exudation Layer Structure: Outermost Layer | Intermediate Layer | Innermost Layer | Structure Relative to Depth Measured: From Boundary Immediately Under Exudation Layer Toward Interior |
|---|---|---|---|---|---|---|
| c-7 | C | 7 | Binder Phase (Co + Ni) 3 μm 90 vol. % | WC 7 μM 90 vol. % | Binder Phase (Co + Ni) 3 μm 90 vol. % | Binder Phase: 1.8 vol. % up to 2.5 μm, thereafter gradually increased, Alloy-Average Volume Percentage at 60 μm WC: Alloy-Average Volume Percentage from Surface Boundary to Interior Hard Phase: Remainder |
| c-8 | C | 8 | Binder Phase (Co + Ni) 3 μm 90 vol. % | WC 7 μM 90 vol. % | Binder Phase (Co + Ni) 3 μm 90 vol. % | Binder Phase: 1.8 vol. % up to 98 μm, thereafter gradually increased, Alloy-Average Volume Percentage at 60 μm WC: Alloy-Average Volume Percentage from Surface Boundary to Interior Hard Phase: Remainder |
| c-9 | C | 9 | Binder Phase (Co + Ni) 3 μm 90 vol. % | WC 7 μM 90 vol. % | Binder Phase (Co + Ni) 3 μm 90 vol. % | Binder Phase: 1.5 vol. % up to 1 μm, thereafter gradually increased, Alloy-Average Volume Percentage at 60 μm WC: Alloy-Average Volume Percentage from Surface Boundary to Interior Hard Phase: Remainder |
| c-10 | C | 10 | Binder Phase (Co + Ni) 3 μm 90 vol. % | WC 7 μM 90 vol. % | Binder Phase (Co + Ni) 3 μm 90 vol. % | Binder Phase: 1.2 vol. % up to 105 μm, thereafter gradually increased, Alloy-Average Volume Percentage at 320 μm WC: Alloy-Average Volume Percentage from Surface Boundary to Interior Hard Phase: Remainder |
| c-11 | C | 11 | Binder Phase (Co + Ni) 3 μm 90 vol. % | WC 7 μM 90 vol. % | Binder Phase (Co + Ni) 3 μm 90 vol. % | Binder Phase: Alloy-Average Volume Percentage from Surface Boundary to Interior WC: 1.8 vol. % up to 1.8 μm, thereafter gradually increased, Alloy-Average Volume Percentage at 250 μm Hard Phase: Remainder |
| c-12 | C | 12 | Binder Phase (Co + Ni) 3 μm 90 vol. % | WC 7 μM 90 vol. % | Binder Phase (Co + Ni) 3 μm 90 vol. % | Binder Phase: Alloy-Average Volume Percentage from Surface Boundary to Interior WC: 1.8 vol. % up to 498 μm, thereafter gradually increased, Alloy-Average Volume Percentage at 700 μm Hard Phase: Remainder |

40

TABLE 21

| Sample No. | Raw Material Grade Powder | Sintering No. | Exudation Layer Structure: Outermost Layer | Intermediate Layer | Innermost Layer | Structure Relative to Depth Measured: From Boundary Immediately Under Exudation Layer Toward Interior |
|---|---|---|---|---|---|---|
| c-13 | C | 13 | Binder Phase (Co + Ni) 3 μm 90 vol. % | WC 7 μM 90 vol. % | Binder Phase (Co + Ni) 3 μm 90 vol. % | Binder Phase: Alloy-Average Volume Percentage from Surface Boundary to Interior WC: 4 vol. % at Surface Boundary, thereafter gradually increased, Alloy-Average Volume Percentage at 60 μm Hard Phase: Remainder |
| c-14 | C | 14 | Binder Phase (Co + Ni) 3 μm 90 vol. % | WC 7 μM 90 vol. % | Binder Phase (CO + Ni) 3 μm 90 vol. % | Binder Phase: Alloy-Average Volume Percentage from Surface Boundary to Interior WC: 1.8 vol. % up to 600 μm, thereafter gradually increased, Alloy-Average Volume Percentage at 900 μm Hard Phase: Remainder |
| c-15 | C | 15 | Binder Phase (Co + Ni) 3 μm 90 vol. % | WC 7 μM 90 vol. % | Binder Phase (Co + Ni) 3 μm 90 vol. % | Binder Phase: 1.7 vol. % up to 2.5 μm, thereafter gradually increased, Alloy-Average Volume Percentage at 60 μm WC: 1.8 vol. % up to 1.8 μm, thereafter gradually increased, |

TABLE 21-continued

| Sample No. | Raw Material Grade Powder | Sintering No. | Exudation Layer Structure Outermost Layer | Intermediate Layer | Innermost Layer | Structure Relative to Depth Measured From Boundary Immediately Under Exudation Layer Toward Interior |
|---|---|---|---|---|---|---|
| d-1 | D | 1 | No | No | Binder Phase (Co + Ni) 3 μm 90 Vol. % | Alloy-Average Volume Percentage at 250 μm Hard Phase: Remainder Binder Phase: Alloy-Average Volume Percentage from Surface Boundary to Interior WC: not contained Hard Phase: Remainder |

TABLE 22

| Sample | (E) | (F) |
|---|---|---|
| c-1 | 39 Inserts | 0.32 mm |
| *c-2 | 16 Inserts | 0.16 mm |
| c-3 | 37 Inserts | 0.33 mm |
| c-4 | 38 Inserts | 0.34 mm |
| c-5 | 39 Inserts | 0.32 mm |
| *c-6 | 17 Inserts | 0.22 mm |
| *c-7 | 10 Inserts | 0.07 mm |
| *c-8 | 10 Inserts | 0.05 mm |
| *c-9 | 11 Inserts | 0.14 mm |
| *c-10 | 19 Inserts | 0.04 mm |
| *c-11 | 10 Inserts | 0.15 mm |
| *c-12 | 10 Inserts | 0.14 mm |
| *c-13 | 12 Inserts | 0.19 mm |
| *c-14 | 17 Inserts | 0.14 mm |
| *c-15 | 5 Inserts | 0.03 mm |

*inventive samples
(E): number of chipped ones among 40 inserts
(F): flank wear width It is understood that thermal shock resistance superior to that of the prior art can be attained when a sintered alloy having a solid solution hard phase consisting of an element belonging to the group 4A, 5A or 6A is provided with an exudation layer as specified. It is also understood that wear resistance and thermal shock resistance are improved respectively when binder phase and WC distributions as specified are provided.

Example 6

The samples a-1 and a-2 shown in Table 11 and the sample d-1 shown in Table 21 were subjected to a thermal shock resistance test under conditions (G). Table 23 shows the results.

(G)

Workpiece: SCM435 (HB: 280) with four flutes

Cutting Speed: 100 (m/min.)

Depth of Cut: 1.5 (mm)

Feed Rate: 0.20 (mm/rev.)

Cutting Time: 30 sec.

Wet Type

TABLE 23

| Sample | (G) |
|---|---|
| *a-2 | 15 Inserts |
| a-1 | 32 Inserts |
| d-1 | 36 Inserts |

*inventive sample
(G): number of chipped ones among 40 inserts

It is understood that an improvement in thermal shock resistance is not recognized despite the existence of an exudation layer, if a layer mainly composed of WC is not also present.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A nitrogen-containing sintered alloy comprising a soft layer at an outermost surface of said alloy, a WC-depleted region immediately beneath said soft layer, and an internal core region beneath said WC-depleted region, wherein:

said sintered alloy has an overall phase content comprising at least 75 wt. % and not more than 95 wt. % of a hard phase and at least 5 wt. % and not more than 25 wt. % of a binder phase, said hard phase comprises WC and $(Ti \cdot W_xM_y)(C_uN_{1-u})$, where M represents at least one metal other than W selected from group 6A of the periodic table, $0<x<1$, $0 \leqq y \leqq 0.9$, and $0 \leqq u<0.9$, with an atomic ratio of N/(C+N) being at least 0.2 and less than 0.5, with at least one of TiC, TiN, and TiCN making up at least 5 wt. % and not more than 60 wt. % of an overall composition of said sintered alloy, and with at least one carbide of at least one metal selected from group 6A of the periodic table including said WC making up at least 30 wt. % and not more than 70 wt. % of said overall composition, said binder phase comprises Ni and Co, said soft layer contains WC and said binder phase, said WC-depleted region contains said binder phase and $(Ti \cdot W_xM_y)(C_uN_{1-u})$ and from 0 to 2 vol. % of WC, and has a thickness of at least 3 μm and not more than 30 μm, and said internal core region contains said binder phase and $(Ti \cdot W_xM_y)(C_uN_{1-u})$ and more than 2 vol. % of WC.

2. The alloy of claim 1, wherein said WC-depleted region contains not more than 1 vol. % of WC.

3. The alloy of claim 1, further comprising a transition region between said WC-depleted region and said internal core region, wherein said transition region has a content gradient of WC that transitions from a content of WC in said WC-depleted region to a content of WC in said internal core region, and wherein a boundary between said transition region and said internal core region is at a depth of at most 1 mm from said outermost surface.

4. The alloy of claim 3, wherein said content of WC in said internal core region is at least 5 vol. % and less than 50 vol. %.

5. The alloy of claim 1, wherein a content of WC in said internal core region is at least 5 vol. % and less than 50 vol. %.

6. The alloy of claim 1, wherein said overall composition comprises at least 20 wt. % and not more than 50 wt. % of at least one of TiC, TiN, and TICN, and at least 40 wt. % and not more than 60 wt. % of at least one carbide of at least one metal selected from group 6A of the periodic table including said WC, and said atomic ratio of N/(C+N) is at least 0.2 and less than 0.4.

7. A nitrogen-containing sintered alloy comprising a soft layer at an outermost surface of said alloy, a WC-depleted region immediately beneath said soft layer, and an internal core region beneath said WC-depleted region, wherein:

said sintered alloy has an overall phase content comprising at least 75 wt. % and not more than 95 wt. % of a hard phase and at least 5 wt. % and not more-than 25 wt. % of a binder phase, said hard phase comprises WC and $(Ti \cdot W_xM_y)(C_uN_{1-u})$, where M represents at least one metal other than Ti and W selected from at least one of groups 4A, 5A and 6A of the periodic table, $0<x<1$, $0 \leqq y \leqq 0.9$, and $0 \leqq u<0.9$, with an atomic ratio of N/(C+N) being at least 0.2 and less than 0.5, and with said $(Ti \cdot W_xM_y)(C_uN_{1-u})$ including constituent components such that said sintered alloy has an overall composition comprising at least 5 wt. % and not more than 60 wt. % of at least one of TiC, TiN, and TiCN, at least 30 wt. % and not more than 70 wt. % of at least one carbide of at least one metal selected from group 6A of the periodic table including said WC, at least 2 wt. % and not more than 15 wt. % total of at least one of TaC, TaN, TaCN, NbC, NbN, and NbCN, and at least 2 wt. % and not more than 5 wt. % total of at least one of VC, VN, VCN, ZrC, ZrN, ZrCN, HfC, HfN, and HfCN, said binder phase comprises Ni and Co, said soft layer contains WC and said binder phase, said WC-depleted region contains said binder phase and $(Ti \cdot W_xM_y)(C_uN_{1-u})$ and from 0 to 2 vol. % of WC, and has a thickness of at least 3 $\mu$m and not more than 30 $\mu$m, and said internal core region contains said binder phase and $(Ti \cdot W_xM_y)(C_uN_{1-u})$ and more than 2 vol. % of WC.

8. The alloy of claim 7, wherein said WC-depleted region contains not more than 1 vol. % of WC.

9. The alloy of claim 7, further comprising a transition region between said WC-depleted region and said internal core region, wherein said transition region has a content gradient of WC that transitions from a content of WC in said WC-depleted region to a content of WC in said internal core region, and wherein a boundary between said transition region and said internal core region is at a depth of at most 1 mm from said outermost surface.

10. The alloy of claim 9, wherein said content of WC in said internal core region is at least 5 vol. % and less than 50 vol. %.

11. The alloy of claim 7, wherein a content of WC in said internal core region is at least 5 vol. % and less than 50 vol. %.

12. The alloy of claim 7, wherein said overall composition comprises at least 20 wt. % and not more than 50 wt. % of at least one of TiC, TiN, and TiCN, and at least 40 wt. % and not more than 60 wt. % of at least one carbide of at least one metal selected from group 6A of the periodic table including said WC, and said atomic ratio of N/(C+N) is at least 0.2 and less than 0.4.

13. A nitrogen-containing sintered alloy, comprising an alloy body and an exudation layer at an outermost surface of said alloy body, wherein:

said sintered alloy has an overall phase content comprising at least 75 wt. % and not more than 95 wt. % of a hard phase and at least 5 wt. % and not more than 25 wt. % of a binder phase, said hard phase comprises WC and $(Ti \cdot W_xM_y)(C_uN_{1-u})$, where M represents at least one metal other than Ti and W selected from at least one of groups 4A, 5A and 6A of the periodic table, $0<x<1$, $0 \leqq y \leqq 0.9$, and $0 \leqq u<0.9$, with an atomic ratio of N/(C+N) being at least 0.2 and less than 0.5, and with said $(Ti \cdot W_xM_y)(C_uN_{1-u})$ including constituent components such that said sintered alloy has an overall composition comprising at least 5 wt. % and not more than 60 wt. % of at least one of TiC, TiN, and TiCN, at least 30 wt. % and not more than 70 wt. % of at least one carbide of at least one metal selected from group 6A of the periodic table including said WC, at least 2 wt. % and not more than 15 wt. % total of at least one of TaC, TaN, TaCN, NbC, NbN, and NbCN, and at least 2 wt. % and not more than 5 wt. % total of at least one of VC, VN, VCN, ZrC, ZrN, ZrCN, HfC, HfN, and HfCN, said binder phase comprises Ni and Co, said exudation layer contains a portion of said WC and said binder phase, and comprises an outermost layer at said outermost surface, an intermediate layer beneath said outermost layer, and an innermost layer beneath said intermediate layer, said outermost layer and said innermost layer each contain more than 0 vol. % and up to 30 vol. % of said WC and a remainder of said binder phase, and each have a thickness of at least 0.1 $\mu$m and not more than 10 $\mu$m, and said intermediate layer contains at least 50 vol. % and less than 100 vol. % of said WC with a remainder comprising said binder phase, and has a thickness of at least 0.5 $\mu$m and not more than 10 $\mu$m.

14. The alloy of claim 13, further comprising a binder-phase-depleted region immediately beneath said exudation layer and between said exudation layer and said internal core region, wherein said binder-phase-depleted region contains said WC, said at least one carbide, nitride or carbonitride, and from 0 to 2 vol. % of said binder phase, and has a thickness of at least 2 $\mu$m and not more than 100 $\mu$m.

15. The alloy of claim 13, further comprising a WC-depleted region immediately beneath said exudation layer and between said exudation layer and said internal core region, wherein said WC-depleted region contains said binder phase, said at least one carbide, nitride or carbonitride, and from 0 to 2 vol. % of said WC, and has a thickness of at least 1 $\mu$m and not more than 500 $\mu$m.

16. The alloy of claim 15, further comprising a transition region between said WC-depleted region and said internal core region, wherein said transition region contains said binder phase, said WC and said at least one carbide, nitride or carbonitride, and has a content gradient of said WC that transitions from a WC content of said WC-depleted region to an average overall volume percentage WC content of said alloy present in said internal core region at a depth of not more than 1 mm from a boundary between said exudation layer and said WC-depleted region.

17. The alloy of claim 14, further comprising a WC-depleted region immediately beneath said exudation layer and overlapping said binder-phase-depleted region, wherein said WC-depleted region contains said binder phase, said at least one carbide, nitride or carbonitride, and from 0 to 2 vol. % of said WC, and has a thickness of at least 1 $\mu$m and not more than 500 $\mu$m.

18. The alloy of claim 17, further comprising a transition region immediately beneath said WC-depleted region, wherein said transition region contains said binder phase, said WC, and said at least one carbide, nitride or carbonitride, and has a content gradient of said WC that transitions from a WC content of said WC-depleted region to an average overall volume percentage WC content of said alloy present in said internal core region at a depth of not more than 1 mm from a boundary between said exudation layer and said WC-depleted region.

19. The alloy of claim 13, wherein said exudation layer consists essentially of said WC and said binder phase.

20. The alloy of claim 13, having an overall composition including from 16 to 40 wt. % of said WC, from 46 to 66 wt. % of said at least one carbide, nitride or carbonitride, and a remainder of said binder phase.

21. The alloy of claim 13, wherein said outermost layer and said innermost layer of said exudation layer each contain more than 0 vol. % and up to 5 vol. % of WC and each have a thickness of 0.1 to 0.5 $\mu$m, and said intermediate layer of said exudation layer contains at least 80 vol. % and less than 100 vol. % of WC and has a thickness from 0.5 to 5 $\mu$m.

22. The alloy of claim 14, wherein said binder-phase-depleted region has a thickness from 2 to 50 $\mu$m.

23. The alloy of claim 15, wherein said WC-depleted region has a thickness from 20 to 100 $\mu$m.

24. The alloy of claim 16, wherein said depth at which said average overall volume percentage of WC is present is in a range from 0.3 to 0.7 mm from said boundary between said exudation layer and said WC-depleted region.

* * * * *

UNITED STATES PATENT AND TRADEMARK OFFICE
CERTIFICATE OF CORRECTION

PATENT NO. : 6,057,046

DATED : May 2, 2000

INVENTOR(S) : TSUDA et al.

It is certified that error appears in the above-identified patent and that said Letters Patent is hereby corrected as shown below:

Col. 3, line 42, after "and", replace "TICN," by --TiCN--;

Col. 13, line 8, before "of", delete "size";

line 50, before "The", replace "conditions" by --conditions.--;

Col. 14, Table 6, col. 3, following the heading:

line 2, replace "_2" by --2--;

line 6, replace "_0" by --0--;

line 65, before "Table", delete "in";

Col. 15, Table 8, col. 5, following the heading:

13th row for Sample No. 17, in 5th column, insert --5-- below "8" and above "20";

Col. 25, Table 18, 1st column under "Sample", 3rd row, replace "*b-3" by --b-3--;

Col. 31, line 14, after "and" (first occurrence), replace "TICN" by --TiCN--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*